US012053059B2

(12) United States Patent
Cungu et al.

(10) Patent No.: US 12,053,059 B2
(45) Date of Patent: Aug. 6, 2024

(54) FASTENER

(71) Applicant: FAN INK LTD., Markham (CA)

(72) Inventors: Gary Cungu, Mississauga (CA); Kevin Au-Yeung, Markham (CA)

(73) Assignee: Fan Ink Ltd., Markham (CA)

( * ) Notice: Subject to any disclaimer, the term of this patent is extended or adjusted under 35 U.S.C. 154(b) by 21 days.

(21) Appl. No.: 17/761,974

(22) PCT Filed: Sep. 18, 2020

(86) PCT No.: PCT/CA2020/051257
§ 371 (c)(1),
(2) Date: Mar. 18, 2022

(87) PCT Pub. No.: WO2021/051205
PCT Pub. Date: Mar. 25, 2021

(65) Prior Publication Data

US 2022/0408883 A1 Dec. 29, 2022

Related U.S. Application Data

(60) Provisional application No. 62/903,300, filed on Sep. 20, 2019.

(51) Int. Cl.
*A42B 1/22* (2006.01)
*A44B 1/06* (2006.01)
*A44B 17/00* (2006.01)

(52) U.S. Cl.
CPC ..... *A44B 1/06* (2013.01); *A44B 17/0029* (2013.01)

(58) Field of Classification Search
CPC ... A42B 1/22; A44B 17/0029; A44B 17/0035; A44B 11/20; A44B 1/06; A41F 1/008
See application file for complete search history.

(56) References Cited

U.S. PATENT DOCUMENTS 1,055,045 A * 3/1913 Hunter ..... A44B 11/22 24/177
1,345,750 A * 7/1920 De Beaumont ..... A44B 11/22 24/DIG. 43

(Continued)

OTHER PUBLICATIONS

International Search Report dated Nov. 30, 2020 from International Patent Application No. PCT/CA2020/051257, 3 pages.

(Continued)

*Primary Examiner* — Robert Sandy
*Assistant Examiner* — Michael S Lee
(74) *Attorney, Agent, or Firm* — Ruggiero McAllister & McMahon LLC

(57) ABSTRACT

A fastener for incorporation into an article of clothing, for example an adjustable cap, is disclosed. The fastener includes a first fastener counterpart and a second fastener counterpart that are co-operatively configured to define a plurality of co-operating connection systems. Each one of the plurality of co-operating connection systems, independently, includes a plurality of first interlocking counterparts and a plurality of second interlocking counterparts. The first and second fastener counterparts are cooperatively configured for disposition in a plurality of connected configurations. The plurality of connected configurations includes at least one multi-coupled connected configuration defined by at least one operative adjacent pair of releasably coupled relationships and participating first interlocking counterparts are releasably coupled with corresponding or participating second interlocking counterparts so that at least one non-participating second interlocking counterpart is disposed between the participating ones of the second interlocking counterparts of the operative adjacent pair of releasably coupled relationships.

30 Claims, 20 Drawing Sheets

(56) References Cited

U.S. PATENT DOCUMENTS

| | | | | |
|---|---|---|---|---|
| 3,798,698 | A * | 3/1974 | Conklin, Jr. | A46B 1/00 15/167.1 |
| 4,179,755 | A * | 12/1979 | Clark | A41F 9/002 2/322 |
| 4,481,681 | A | 11/1984 | Hankin | |
| D299,380 | S | 1/1989 | Wang | |
| 5,226,809 | A * | 7/1993 | Franco | G09F 3/00 40/625 |
| 10,238,161 | B1 * | 3/2019 | Ong | A44B 99/005 |
| 2016/0278466 | A1 * | 9/2016 | Hwang | A42B 1/22 |
| 2018/0035763 | A1 * | 2/2018 | Kumuchian | A44B 11/22 |

OTHER PUBLICATIONS

Written Opinion dated Nov. 30, 2020 from International Patent Application No. PCT/CA2020/051257, 5 pages.

* cited by examiner

FASTENER

This application is a national stage entry of International Application No. PCT/CA2020/051257 filed on Sep. 18, 2020, which claims priority from U.S. Provisional Application No. 62/903,300 filed on Sep. 20, 2019, each of which is incorporated herein by reference in its entirety.

BACKGROUND OF THE DISCLOSURE

1. Field of the Disclosure

The present disclosure relates to a fastener for releasably coupling two or more parts to one another. The fastener may be particularly suited for incorporation into an article of clothing for allowing size adjustment of the clothing, for instance a headwear article to allow the headwear to be adapted to various head sizes

2. Description of the Related Art

Some articles of clothing often include fasteners or adjustment mechanisms that allow the size of an opening associated with the article of clothing to be adjusted or varied. For example, headwear can come in many forms including hats, caps, and visors, etc. which may be fitted or adjustable. Adjustable headwear typically incorporate an adjustment mechanism or fastener that permits the size of the opening for receiving the heat of a wearer to be adjusted to accommodate wearers with various head dimensions. Such adjustment mechanisms are often found on baseball-style caps, although they can be used in any headwear design. The adjustment mechanisms can also be incorporated into articles of clothing other than headwear.

Conventional, adjustable baseball-style hats or caps often include a rear portion of the baseball cap which includes an opening or cut-out from which two overlapping straps extend, the straps extending into the opening or cut-out from opposite edges of the opening or cut-out. One of the straps generally includes a plurality of protrusions and the other strap generally includes a plurality of corresponding apertures. By snapping the protrusions of one strap component into different apertures of the other strap component, the circumference of the head opening of the baseball cap can be adjusted to accommodate the head size of different wearers.

However, the circumference of the opening defined by these conventional baseball-style caps can typically only be adjusted at increments as defined by the distance between the corresponding apertures into which the corresponding protrusions snap. In conventional baseball-style hats or caps, the protrusions and openings are disposed in a ratio of 1:1. This type of adjustment mechanism does not allow for finer adjustments of the opening defined by the cap or hat for wearer's whose head size does not correspond with the relatively large incremental circumference options provided by baseball caps incorporating conventional adjustment mechanisms or straps.

Accordingly, an adjustment mechanism or fastener that allows for finer size adjustments of an article of clothing or cap is desirable.

SUMMARY

In accordance with an aspect of the present disclosure, there is provided a fastener, for incorporating into an article of clothing, for allowing size adjustment of the clothing, the fastener comprising: a first fastener counterpart including a plurality of first interlocking counterparts, each one of the first interlocking counterparts being disposed on a longitudinal axis of the first fastener counterpart; a second fastener counterpart including a plurality of second interlocking counterparts, each one of the second interlocking counterparts being disposed on a longitudinal axis of the second fastener counterpart; the first fastener counterpart and the second fastener counterpart are co-operatively configured for connection in a plurality of connected configurations; wherein: for each one of the plurality of connected configurations, independently: the second fastener counterpart overlaps the first fastener counterpart; the extent of the overlap is different relative to the overlap of every other one of the other connected configurations; the connection is established by at least one releasably coupled relationship; and each one of the at least one releasably coupled relationship, independently, is established by releasable coupling between a participating one of the first interlocking counterparts and a participating one of the second interlocking counterparts; the plurality of connected configurations include at least one multi-coupled connected configuration; for each one of the at least one multi-coupled connected configuration, independently: the at least one releasably coupled relationship is "N" releasably coupled relationships, wherein "N" is an integer that is greater than or equal to two (2); the "N" releasably coupled relationships includes "N−1" adjacent pairs of releasably coupled relationships; at least one of the at least one multi-coupled connected configuration is an operative multi-coupled connected configuration; and for each one of the at least one operative multi-coupled connected configuration, independently: the "N−1" adjacent pairs of releasably coupled relationships include at least one operative adjacent pair of releasably coupled relationships; and for each one of the at least one operative adjacent pair of releasably coupled relationships, independently: at least one non-participating second interlocking counterpart, of the second interlocking counterparts, is disposed between the participating second interlocking counterparts of the operative adjacent pair; each one of the participating first interlocking counterparts of the operative adjacent pair, independently, is an operative participating first interlocking counterpart; and each one of the at least one non-participating second interlocking counterpart that is disposed between the operative participating second interlocking counterparts of the operative adjacent pair, independently, is an operative non-participating second interlocking counterpart.

In accordance with another aspect of the present disclosure there is provided a fastener, for incorporating into an article of clothing, for allowing size adjustment of the clothing, the fastener comprising: a first fastener counterpart; and second fastener counterpart; wherein: the first and second fastener counterparts are co-operatively configured to define a plurality of co-operating connection systems; each one of the plurality of co-operating connection systems, independently, includes a plurality of first interlocking counterparts and a plurality of second interlocking counterparts;

for each one of the co-operating connection systems, independently: the plurality of first interlocking counterparts are defined by the first fastener counterpart and disposed along a longitudinal axis, of the first fastener counterpart, that is respective to the co-operating connection system; and the plurality of second interlocking counterparts are defined by the second fastener counterpart and disposed along a longitudinal axis, of the second fastener counterpart, that is respective to the co-operating connection system; each one of the co-operating connection systems, independently, is configurable in a plurality of connected connection system configurations; for each one of the co-operating connection systems, independently: each one of the plurality of connected connection system configurations, independently, includes at least one releasably coupled relationship; each one of the at least one releasably coupled relationship, independently, is defined by releasable coupling between a participating one of the first interlocking counterparts and a participating one of the second interlocking counterparts; the plurality of connected connection system configurations include at least one multi-coupled connected configuration; and for each one of the at least one multi-coupled connected configuration, independently: the at least one releasably coupled relationship is "N" releasably coupled relationships, wherein "N" is an integer that is greater than or equal to two (2); the "N" releasably coupled relationships includes "N−1" adjacent pairs of releasably coupled relationships; at least one of the at least one multi-coupled connected configuration is an operative multi-coupled connected configuration, such that at least one operative multi-coupled connected configuration is provided; and for each one of the at least one operative multi-coupled connected configuration, independently: the "N−1" adjacent pairs of releasably coupled relationships include at least one operative adjacent pair of releasably coupled relationships; and for each one of the at least one operative adjacent pair of releasably coupled relationships, independently: at least one non-participating second interlocking counterpart, of the second interlocking counterparts, is disposed between the participating second interlocking counterparts of the operative adjacent pair; each one of the participating first interlocking counterparts of the operative adjacent pair, independently, is an operative participating first interlocking counterpart; and each one of the at least one non-participating second interlocking counterpart that is disposed between the participating second interlocking counterparts of the operative adjacent pair, independently, is an operative non-participating second interlocking counterpart.

In accordance with another aspect of the present disclosure, there is provided a fastener, for incorporating into an article of clothing, for allowing size adjustment of the clothing, the fastener comprising a first fastener counterpart and a second fastener counterpart, wherein: the first and second fastener counterparts are co-operatively configured to define a plurality of co-operating connection systems; each one of the plurality of co-operating connection systems, independently, includes a plurality of first interlocking counterparts and a plurality of second interlocking counterparts; for each one of the co-operating connection systems, independently: the plurality of first interlocking counterparts are defined by the first fastener counterpart and disposed along a longitudinal axis, of the first fastener counterpart, that is respective to the co-operating connection system; and the plurality of second interlocking counterparts are defined by the second fastener counterpart and disposed along a longitudinal axis, of the second fastener counterpart, that is respective to the co-operating connection system; the first fastener counterpart and the second fastener counterpart are co-operatively configured for connection in a plurality of connected configurations; wherein, for each one of the plurality of connected configurations, independently, the second fastener counterpart overlaps the first fastener counterpart; the extent of the overlap is different relative to the overlap of every other one of the other connected configurations; the connection is established by at least one releasably coupled relationship in at least one of the plurality of co-operating connection systems; each one of the at least one releasably coupled relationship, independently, is defined by releasable coupling between a participating one of the first interlocking counterparts and a participating one of the second interlocking counterparts; and each one of the co-operating connection systems, independently, is configurable in a plurality of connected connection system configurations; for each one of the co-operating connection systems, independently, the plurality of connected connection system configurations include at least one multi-coupled connected configuration; for each one of the at least one multi-coupled connected configuration, independently, the connection of the connected connection system configuration is established by: "N" releasably coupled relationships, wherein "N" is an integer that is greater than or equal to two (2); the "N" releasably coupled relationships includes "N−1" adjacent pairs of releasably coupled relationships; at least one of the at least one multi-coupled connected configuration is an operative multi-coupled connected configuration, such that at least one operative multi-coupled connected configuration is provided; and for each one of the at least one operative multi-coupled connected configuration, independently: the "N−1" adjacent pairs of releasably coupled relationships include at least one operative adjacent pair of releasably coupled relationships; and for each one of the at least one operative adjacent pair of releasably coupled relationships, independently: at least one non-participating second interlocking counterpart, of the second interlocking counterparts, is disposed between the participating second interlocking counterparts of the operative adjacent pair; each one of the participating first interlocking counterparts of the operative adjacent pair, independently, is an operative participating first interlocking counterpart; and each one of the at least one non-participating second interlocking counterpart that is disposed between the participating second interlocking counterparts of the operative adjacent pair, independently, is an operative non-participating second interlocking counterpart.

In accordance with another aspect of the present disclosure, there is provided a fastener, for incorporating into an article of clothing, for allowing size adjustment of the clothing, the fastener comprising: a first fastener counterpart; and second fastener counterpart; wherein: the first and second fastener counterparts are co-operatively configured to define a plurality of co-operating connection systems; each one of the plurality of co-operating connection systems, independently, includes a plurality of first interlocking counterparts and a plurality of second interlocking counterparts; for each one of the co-operating connection systems, independently: the plurality of first interlocking counterparts are defined by the first fastener counterpart and disposed along a longitudinal axis, of the first fastener counterpart, that is respective to the co-operating connection system; and the plurality of second interlocking counterparts are defined by the second fastener counterpart and disposed along a longitudinal axis, of the second fastener counterpart, that is respective to the co-operating connection system; each one of the co-operating connection systems, independently, is configurable in a plurality of connected connection system configurations; for at least one of the co-operating connection systems, independently: each one of the plurality of connected connection system configurations, independently, includes at least one releasably coupled relationship; each one of the at least one releasably coupled relationship, independently, is defined by releasable coupling between a participating one of the first interlocking counterparts and a participating one of the second interlocking counterparts; the plurality of connected connection system configurations include at least one multi-coupled connected configuration; and for each one of the at least one multi-coupled connected configuration, independently: the at least one releasably coupled relationship is "N" releasably coupled relationships, wherein "N" is an integer that is greater than or equal to two (2); the "N" releasably coupled relationships includes "N−1" adjacent pairs of releasably coupled relationships; at least one of the at least one multi-coupled connected configuration is an operative multi-coupled connected configuration, such that at least one operative multi-coupled connected configuration is provided; and for each one of the at least one operative multi-coupled connected configuration, independently: the "N−1" adjacent pairs of releasably coupled relationships include at least one operative adjacent pair of releasably coupled relationships; and for each one of the at least one operative adjacent pair of releasably coupled relationships, independently: at least one non-participating second interlocking counterpart, of the second interlocking counterparts, is disposed between the participating second interlocking counterparts of the operative adjacent pair; each one of the participating first interlocking counterparts of the operative adjacent pair, independently, is an operative participating first interlocking counterpart; and each one of the at least one non-participating second interlocking counterpart that is disposed between the participating second interlocking counterparts of the operative adjacent pair, independently, is an operative non-participating second interlocking counterpart.

In accordance with another aspect of the present disclosure, there is provided an article of clothing defining an opening for receiving a human body part and including a fastener for allowing adjustment to the size of the opening, the fastener comprising a first fastener counterpart; and second fastener counterpart; wherein: the first and second fastener counterparts are co-operatively configured to define a plurality of co-operating connection systems; each one of the plurality of co-operating connection systems, independently, includes a plurality of first interlocking counterparts and a plurality of second interlocking counterparts;

for each one of the co-operating connection systems, independently: the plurality of first interlocking counterparts are defined by the first fastener counterpart and disposed along a longitudinal axis, of the first fastener counterpart, that is respective to the co-operating connection system; and the plurality of second interlocking counterparts are defined by the second fastener counterpart and disposed along a longitudinal axis, of the second fastener counterpart, that is respective to the co-operating connection system; each one of the co-operating connection systems, independently, is configurable in a plurality of connected connection system configurations; for each one of the co-operating connection systems, independently: each one of the plurality of connected connection system configurations, independently, includes at least one releasably coupled relationship; each one of the at least one releasably coupled relationship, independently, is defined by releasable coupling between a participating one of the first interlocking counterparts and a participating one of the second interlocking counterparts; the plurality of connected connection system configurations include at least one multi-coupled connected configuration; and for each one of the at least one multi-coupled connected configuration, independently: the at least one releasably coupled relationship is "N" releasably coupled relationships, wherein "N" is an integer that is greater than or equal to two (2); the "N" releasably coupled relationships includes "N−1" adjacent pairs of releasably coupled relationships; at least one of the at least one multi-coupled connected configuration is an operative multi-coupled connected configuration, such that at least one operative multi-coupled connected configuration is provided; and for each one of the at least one operative multi-coupled connected configuration, independently: the "N−1" adjacent pairs of releasably coupled relationships include at least one operative adjacent pair of releasably coupled relationships; and for each one of the at least one operative adjacent pair of releasably coupled relationships, independently: at least one non-participating second interlocking counterpart, of the second interlocking counterparts, is disposed between the participating second interlocking counterparts of the operative adjacent pair; each one of the participating first interlocking counterparts of the operative adjacent pair, independently, is an operative participating first interlocking counterpart; and each one of the at least one non-participating second interlocking counterpart that is disposed between the participating second interlocking counterparts of the operative adjacent pair, independently, is an operative non-participating second interlocking counterpart.

In accordance with another aspect of the present disclosure, there is provided an adjustable-size cap, comprising: a crown portion configured for receiving and residing over a wearer's head, the crown portion defining a bottom edge and a circumferential inside surface configured for disposition against the wearer's head; a visor extending from a front portion of the bottom edge of the crown portion; and opening disposed within the crown portion and disposed generally opposite to the visor, the opening extending through the bottom edge and defining first and second oppositely disposed edge portion; and a fastener according to example embodiments of the present disclosure.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DETAILED DESCRIPTION

Figure 1:
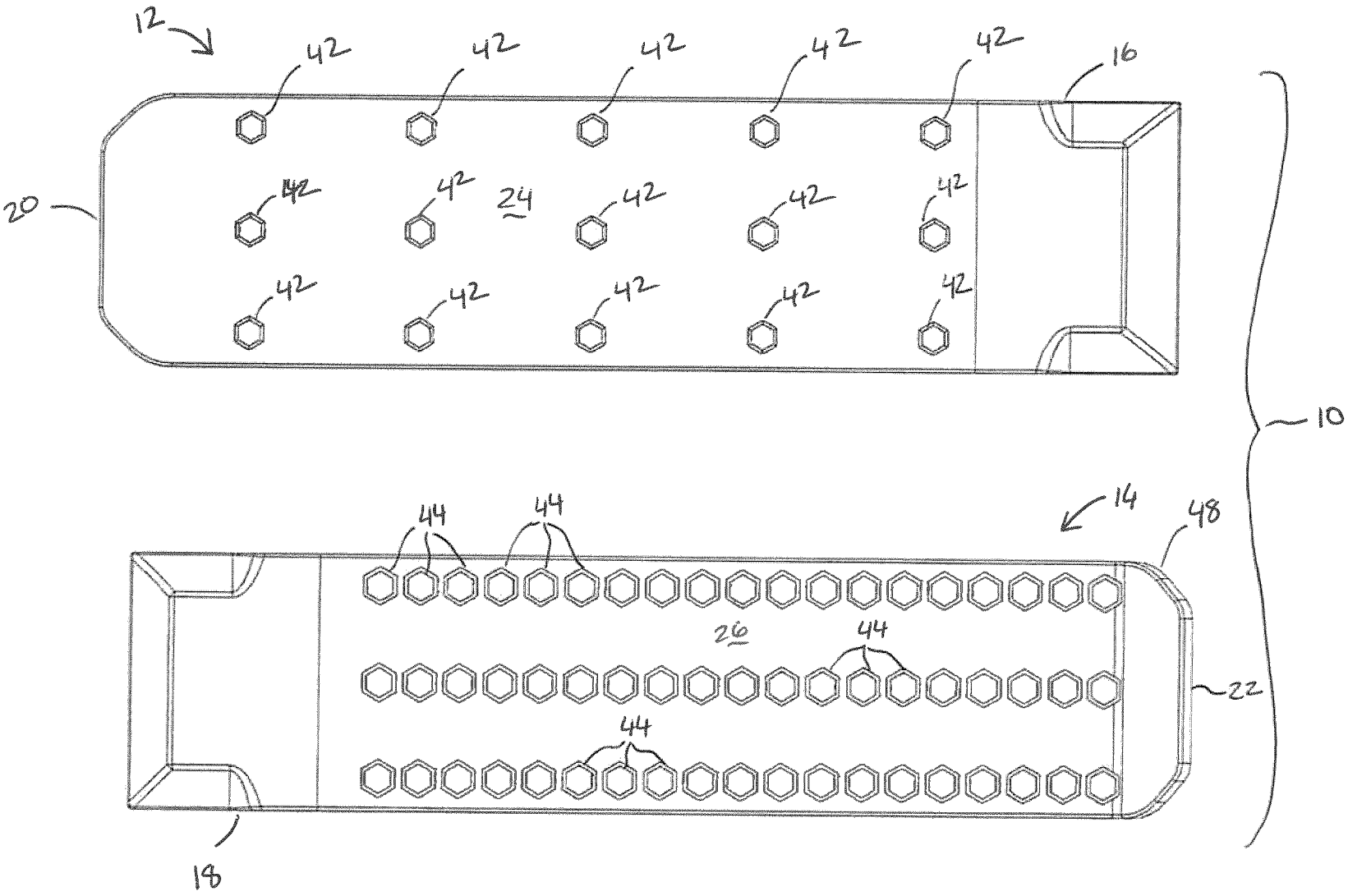
FIG. 1 is a plan view of a fastener according to an example embodiment of the present disclosure in an open or un-connected configuration.

The following is a description of a fastener 10 for releasably coupling two or more parts together in a plurality of different connected configurations according to example embodiments of the present disclosure.

In some embodiments, for example, the fastener is incorporated into an article of clothing 100 having an opening 110 for receiving a body part of a user, the fastener 10 enabling a wearer to adjust the size of the opening 110 associated with the article of clothing 100 for a comfortable fit. In some embodiments, for example, the article of clothing 100 includes an adjustable cap or hat 1100 configured for receiving a users' head. However, it will be understood that the fastener 10 may be incorporated into other articles of clothing or accessories for wearing by a user that are other than a hat.

Referring to FIGS. 1-14, there is shown a fastener 10 according to an example embodiment of the present disclosure. As illustrated, fastener 10 comprises a first fastener counterpart 12 and a second fastener counterpart 14. In some embodiments, for example, each one of the first fastener counterpart 12 and the second fastener counterpart 14, independently, is a generally elongate member. In the subject example embodiment, the first fastener counterpart 12 and the second fastener counterpart 14 each extend between a respective first end 16, 18 and a respective second, free end portion 20, 22 that is disposed opposite to and distal from the corresponding first end portion 16, 18. The first fastener counterpart 12 and the second fastener counterpart 14 each define a first side, or first face 24, 26, respectively, and a second side or second face 28, 30 that is disposed opposite to the corresponding first side 24, 26. In some embodiments, for example, the first end portion 16, 18 of each of the first fastener counterpart 12 and the second fastener counterpart 14 is an article-engaging portion for securing the respective one of the first fastener counterpart 12 and the second fastener counterpart 14 to a respective, oppositely disposed edge or edge portion of an article of clothing 100 such that the second, free end 20 of the first fastener counterpart 12 and the second, free end 22 of the second fastener counterpart are disposed opposite to one another and extends towards each other from the oppositely disposed edges or edge portions of the article of clothing 100. In some embodiments, for example, the first fastener counterpart 12 includes a strap, and the second fastener counterpart 14 includes a strap.

In some embodiments, for example, the first fastener counterpart 12 and the second fastener counterpart 14 are co-operatively configured to define a plurality of co-operating connection systems 40. Each one of the plurality of co-operating connection systems 40, independently, includes a plurality of first interlocking counterparts 42 and a plurality of second interlocking counterparts 44.

For each one of the co-operating connection systems 40, the plurality of first interlocking counterparts 42 are defined by the first fastener counterpart 12 and are disposed along a longitudinal axis, X1, of the first fastener counterpart 12, that is respective to the co-operating connection system 40. Similarly, the plurality of second interlocking counterparts 44 are defined by the second fastener counterpart 14 and are disposed along a longitudinal axis, X2, of the second fastener counterpart 14, that is respective to the co-operating connection system 40.

Figure 17:
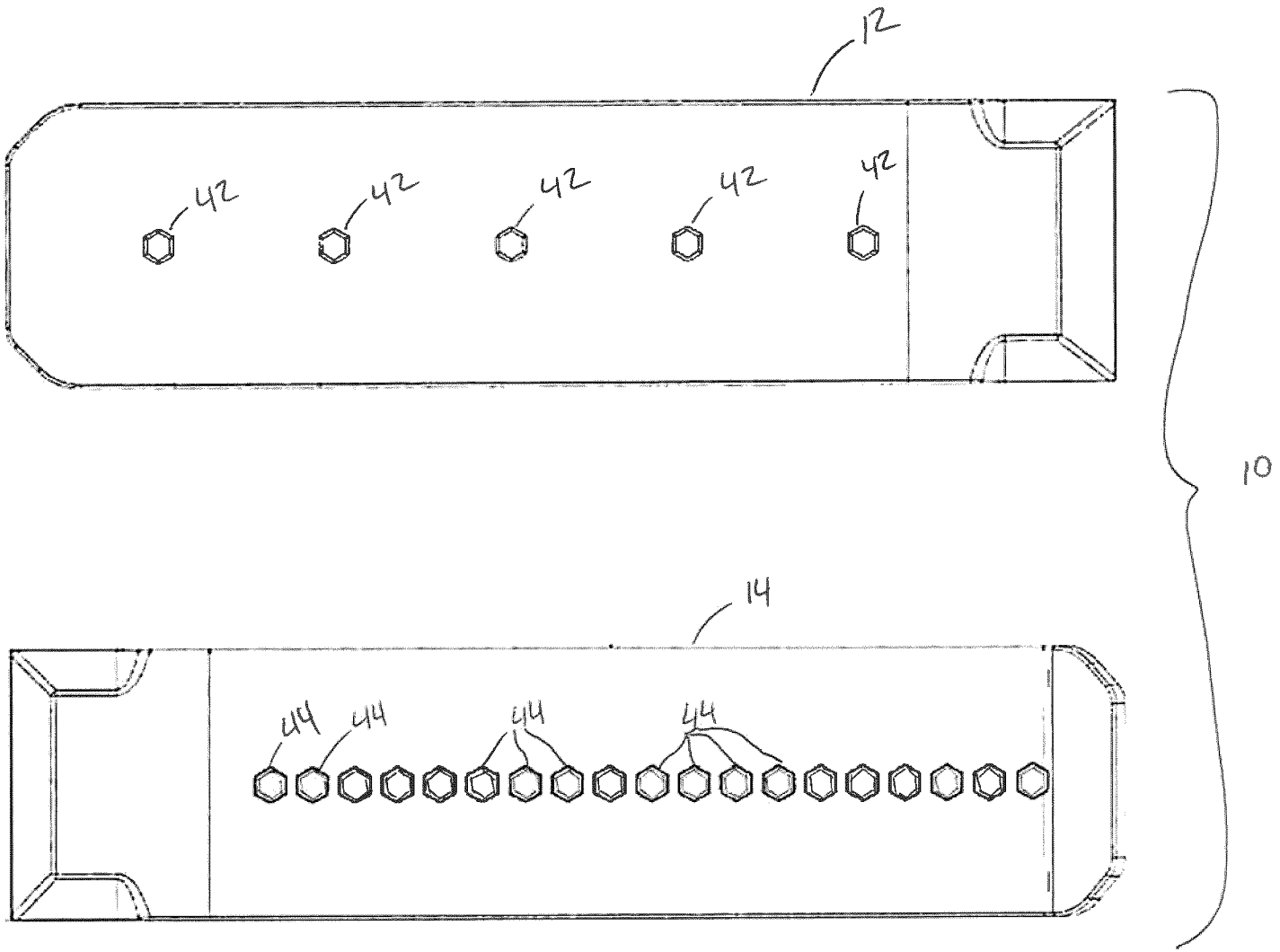
FIG. 17 is a plan view of a fastener according to an alternate example embodiment of the present disclosure in an open or un-connected configuration.
Figure 18:
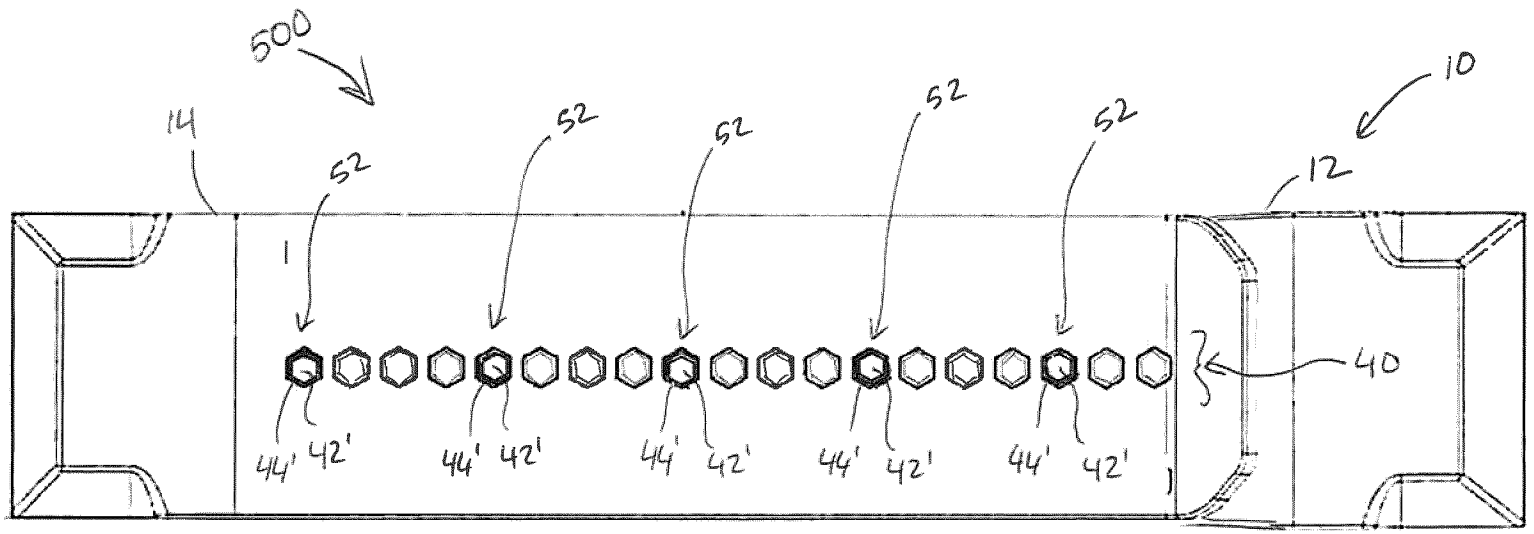
FIG. 18 is a plan view of the fastener of FIG. 17 in one of a plurality of connected configurations.
Figure 22:
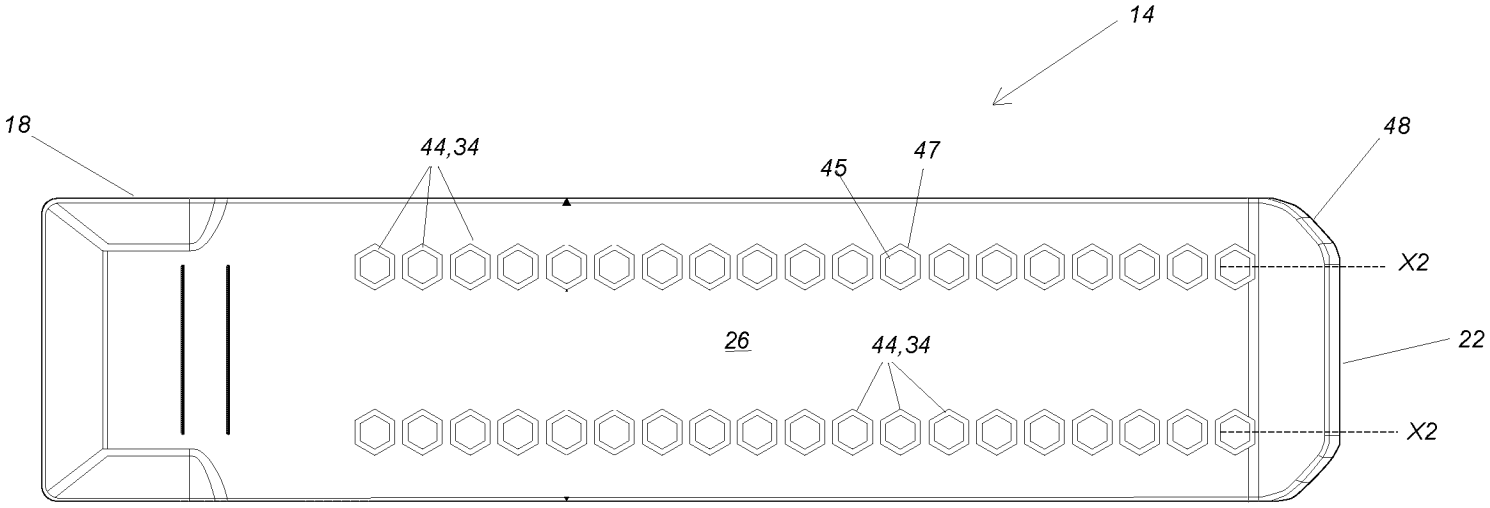
FIG. 22 is a front plan view of the second fastener counterpart of a fastener according to another example embodiment of the present disclosure.
Figure 23:
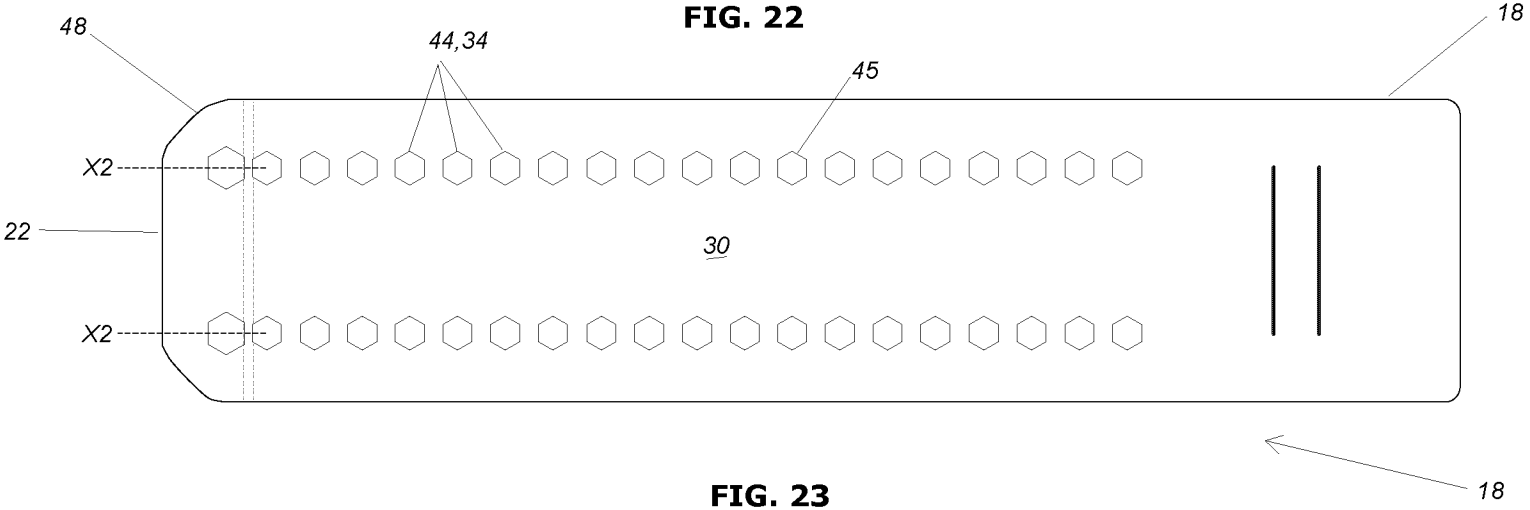
FIG. 23 is a rear plan view of the second fastener counterpart of FIG. 22.
Figure 24:
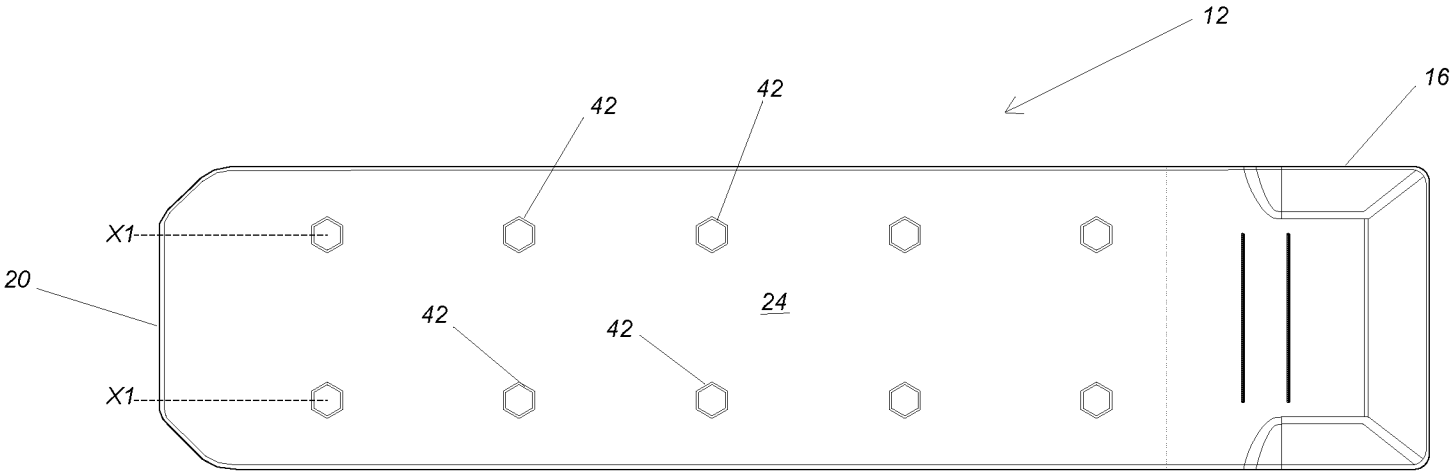
FIG. 24 is front plan view of the first fastener counterpart for use with the second fastener counterpart of FIGS. 22-23.

In some embodiments, for example, the longitudinal axis X1, X2 that is respective to a one of the co-operating connection systems 40 is parallel to the respective longitudinal axis X1, X2 of every other one of the co-operating connection systems 40. In the subject example embodiment illustrated in FIGS. 1-14, the fastener 10 includes three co-operating connections systems 40(1), 40(2) and 40(3) that are spaced apart from one another and disposed parallel to each other along their respective longitudinal axis, X1, X2. Accordingly, with reference, for example, to the embodiment illustrated in FIG. 8, each of the three co-operating connection systems 40(1), 40(2) and 40(3) that are disposed along their respective longitudinal axis X1, X2, are spaced apart relative to one another along an axis Y1, Y2 that extends transverse to each of the respective longitudinal axis X1, X2 of the co-operating connection system 40(1), 40(2) and 40(3). However, it will be understood that, in some embodiments, the fastener 10 may include fewer co-operating connections systems 40 than three, while in other embodiments, the fastener 10 may include more co-operating connection systems 40 than those included in the illustrated example embodiment and that the total number of co-operating connection systems 40 may exceed three and will vary depending on the overall size and particular application of the fastener 10. An example embodiment of the fastener 10 having only a single co-operating connection system 40 is illustrated in FIGS. 17 and 18 in an unconnected or open condition, and disposed in a multi-coupled connected configuration 500. With reference, in particular, to FIGS. 22-24 there is shown an example embodiment of a fastener 10 having only two co-operating connection system 40(1), 40(2). As shown in FIG. 24, the first fastener counterpart 12 has two spaced apart, parallel rows of first interlocking counterparts 42 where each row is configured for co-operating with a corresponding row of second interlocking counterparts 44 included on the second fastener counterpart 14.

In some embodiments, for example, each one of the plurality of first interlocking counterparts 42, independently, includes a protrusion 32 and each one of the plurality of second interlocking counterparts 44, independently, includes a receiver 34.

In some embodiments, for example, the receiver 34 includes an aperture.

In some embodiments, for example, the protrusions 32 include posts 33 that extend orthogonally from the surface of the first side 24 of the first fastener counterpart 12.

In some embodiments, for example, each protrusion 32, independently, has a polyhedron shape.

In some embodiments for example, each protrusion 32, independently, is a hexagonal polyhedron in shape.

In some embodiments for example, each protrusion 32, independently, has a cylindrical shape.

Figure 3:
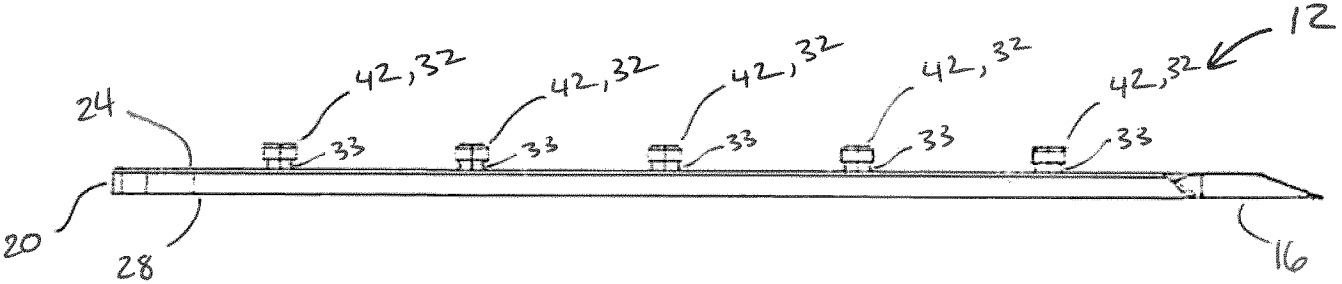
FIG. 3 is a side elevation view of the first fastener counterpart of FIG. 2.
Figure 4:
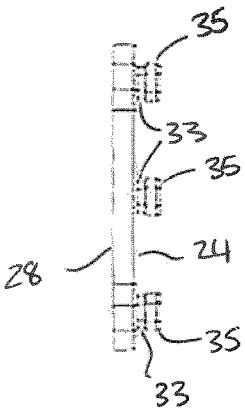
FIG. 4 is a left end elevation view of the first fastener counterpart of FIG. 2.
Figure 2A:
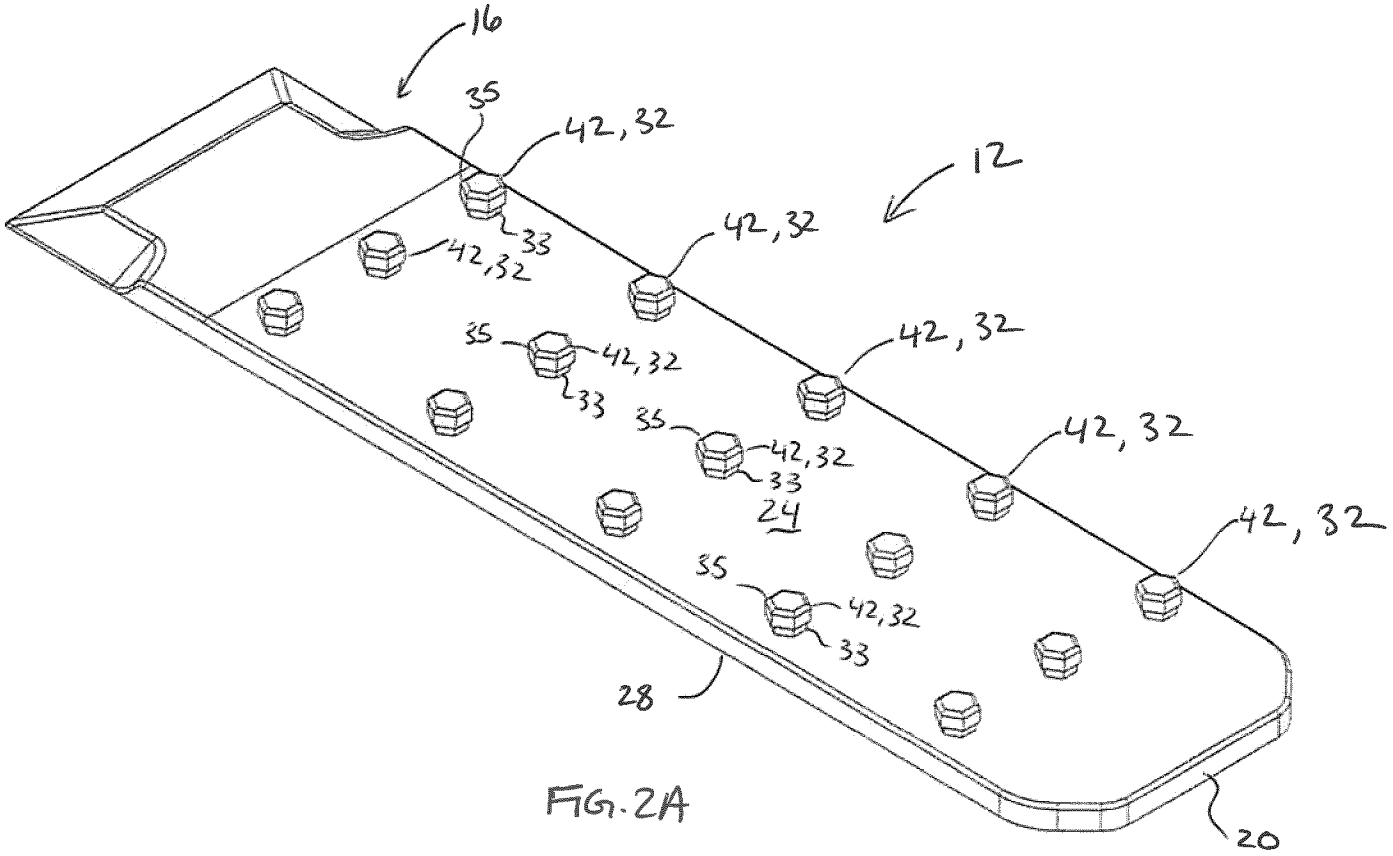
FIG. 2A is a perspective view of the first fastener counterpart of FIG. 1, in isolation.

In some embodiments, for example as shown in FIGS. 3 and 4, each of the first interlocking counterparts 42, or protrusions 32, includes a post 33 and a head 35 that extends from the post 33 such that the head 35 is disposed at the most distal end of the post 33. In some embodiments, for example, the diameter of the head 35 (or the width of the head 35 as measured along the longitudinal axis X1 that is respective to the corresponding cooperating connection system 40) is larger than the diameter of the post 33 (or the width of the post 33 as measured along the longitudinal axis X1 that is respective to the corresponding cooperating connection system 40). In some embodiments, for example, the head 35 of each of the first interlocking counterparts 42 has a diameter (or a width, as measured along the longitudinal axis X1 that is respective to the co-operating connection system 40) of at least 2.15 mm, while the post 33 has a diameter (or width as measured along the longitudinal axis X1 that is respective to the co-operating connection system 40) of at least 1.75 mm.

Figure 7:
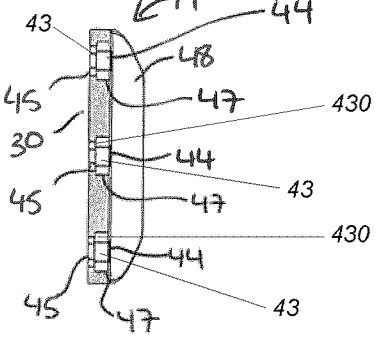
FIG. 7 is a cross-sectional view of the second fastener counterpart taken along section line 7-7 of FIG. 5.
Figure 5A:
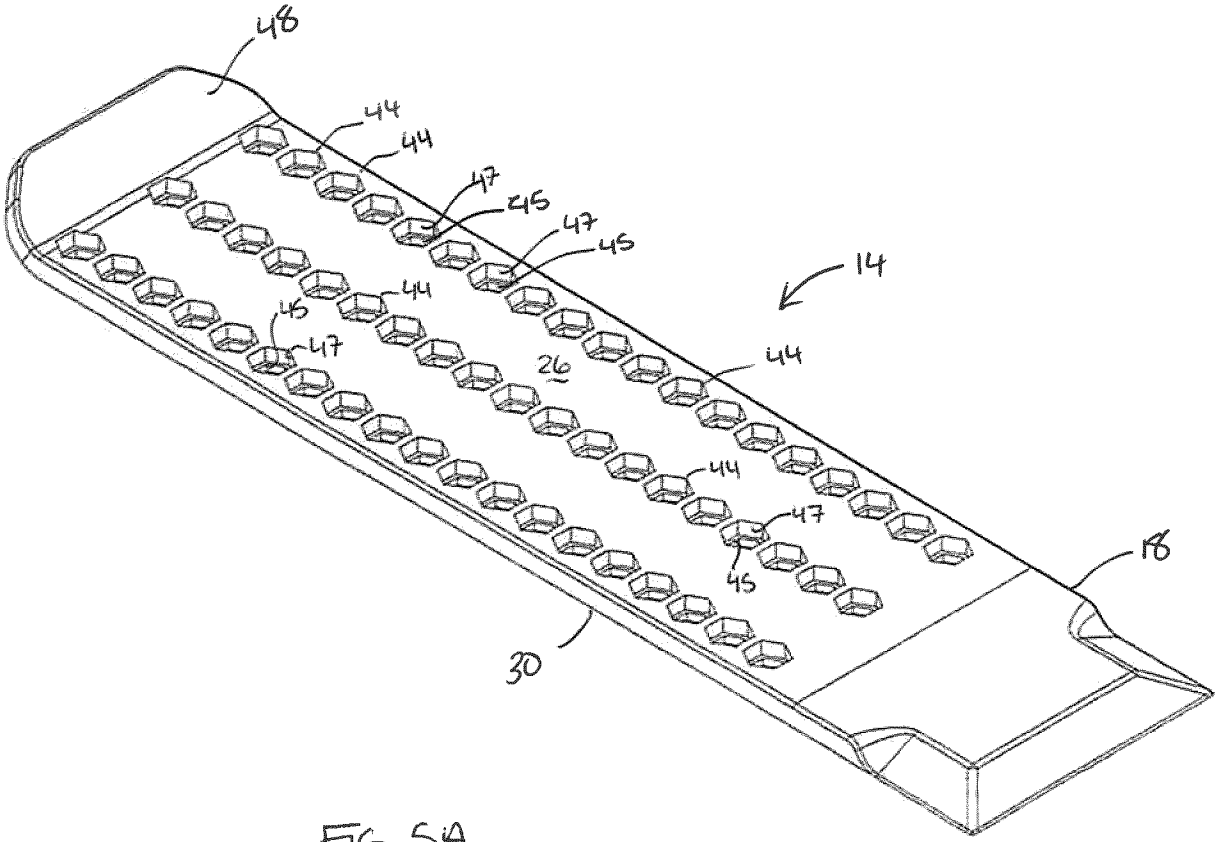
FIG. 5A is a perspective view of the second fastener counterpart of FIG. 1, in isolation.

In some embodiments, for example, each of the second interlocking counterparts 44 is an aperture 43 that is configured for receiving and co-operating with a corresponding one of the first interlocking counterparts 42 such that the first interlocking counterpart 42 becomes engaged within the aperture 43 with effect that the second fastener counterpart 14 is fastened to the first fastener counterpart 12. In some embodiments, for example, as illustrated in FIG. 7, the aperture 43 has a stepped profile wherein a first portion 45 of the aperture 43 has a first diameter and a second portion 47 of the aperture 43 has a second diameter, wherein the first diameter is smaller than the second diameter. The first portion 45 of the aperture 43 extends into the second fastener counterpart 14 from the second surface 30 to part way through the thickness of substrate that defines the second fastener counterpart 14, while the second portion 47 extends from the first portion 45, from within the substrate that defines the second fastener counterpart 14, through to the first surface 26 of the second fastener counterpart 14. As the second fastener counterpart 14 is disposed in overlapping relationship with the first fastener counterpart 12, the head 35 of each of the first interlocking counterparts 42 squeezes through the first portion 45 of the aperture 43 and is released into the second portion 47 of the aperture 43, with the post 33 of the first interlocking counterpart 42 remaining embedded within the first portion 45 of the aperture 43 and the head 35 of the first interlocking counterpart 42 impinging against the shoulder or stepped surface 430 defined by the stepped profile of the aperture 43. In order to effect disconnection of the second fastener counterpart 14 from the first fastener counterpart 12, the head 35 of each of the first interlocking counterparts 42 must squeeze or be manipulated through the narrower first portion 45 of the aperture 43 in order to release the first interlocking counterpart 42 from the second interlocking counterpart 44. Accordingly, in some embodiments, for example, the stepped profile defined by the aperture 43 and the post 33 and head 35 configuration of the first interlocking counterpart 42 provides a more secure and/or more robust releasable connection between the second fastener counterpart 14 and the first fastener counterpart 12 since the participating ones of the first interlocking counterparts 42 are more securely engaged within the participating ones of the second interlocking counterparts 44. In some embodiments, for example, the first portion 45 of the aperture 43 has a diameter or width, as measured along the longitudinal axis X2 of the second fastener counterpart 14 that is respective to the co-operating connection system 40, of at least 2.31 mm while the second portion 47 has a diameter or width, as measured along the longitudinal axis X2 of the second fastener counterpart 14 that is respective to the co-operating connection system 40, of at least 3.00 mm.

In some embodiments, for example, the plurality of second interlocking counterparts 44 are configured so as to generally correspond to the shape of the plurality of first interlocking counterparts 42. In some embodiments, for example, the plurality of second interlocking counterparts 44 are configured so as to generally correspond to the shape of the head 35 of the plurality of first interlocking counterparts 42. Accordingly, in some embodiments, for example, each second interlocking counterpart 44 has a polygonal shape, in correspondence with the polygonal shape of the first interlocking counterparts 42. In the example embodiments illustrated in FIGS. 1-21, for example, the plurality of second interlocking counterparts 44 are generally hexagonal in shape in order to correspond with the hexagonal polyhedron shape of the plurality of first interlocking counterparts 42. It will be understood, however, that the plurality of first interlocking counterparts 42 and that the plurality of second interlocking counterparts 44 may comprise another one of various other forms or configurations rather than the example embodiments described above so long as each first interlocking counterpart 42 is configured for releasable engagement or releasable coupling with the plurality of second interlocking counterparts 44. Accordingly, it will be understood that, in some embodiments, the first interlocking counterparts 42 may be cylindrical posts and the second interlocking counterparts 44 may have a complementary, circular shape.

In some embodiments, for example, the first fastener counterpart 12 is made from a first fastener counterpart material, such as, for example, by molding (e.g. injection molding), and the second fastener counterpart 14 is made from a second fastener counterpart material, such as, for example, by molding (e.g. injection molding). In some embodiments, for example, the first fastener counterpart material is polyethylene or a mixture comprising polyethylene and one or more other polymers, and examples of such other polymers include a polyolefin elastomer (POE) and ethylene-vinyl acetate. In some embodiments, for example, the polyethylene is one of: low-density polyethylene, high-density polyethylene, or a combination of low-density polyethylene and high-density polyethylene. In some embodiments, for example, the first fastener counterpart material is one of: polyethylene terephthalate, polypropylene, or silicone, or any combination thereof, or other rubber-like material.

In some embodiments, for example, the second fastener counterpart material is polyethylene or a mixture comprising polyethylene and one or more other polymers, and examples of such other polymers include a polyolefin elastomer (POE) and ethylene-vinyl acetate. In some embodiments, for example, the polyethylene is one of: low-density polyethylene, high-density polyethylene, or a combination of low-density polyethylene and high-density polyethylene. In some embodiments, for example, the second fastener counterpart material is one of: polyethylene terephthalate, polypropylene, or silicone, or any combination thereof, or other rubber-like material.

In some embodiments, for example the first fastener counterpart material and the second counterpart material are the same. In some embodiments, for example, the first fastener counterpart material is different than the second fastener counterpart material. In some embodiments, for example, the first fastener counterpart material is softer than the second fastener counterpart material.

Figure 8:
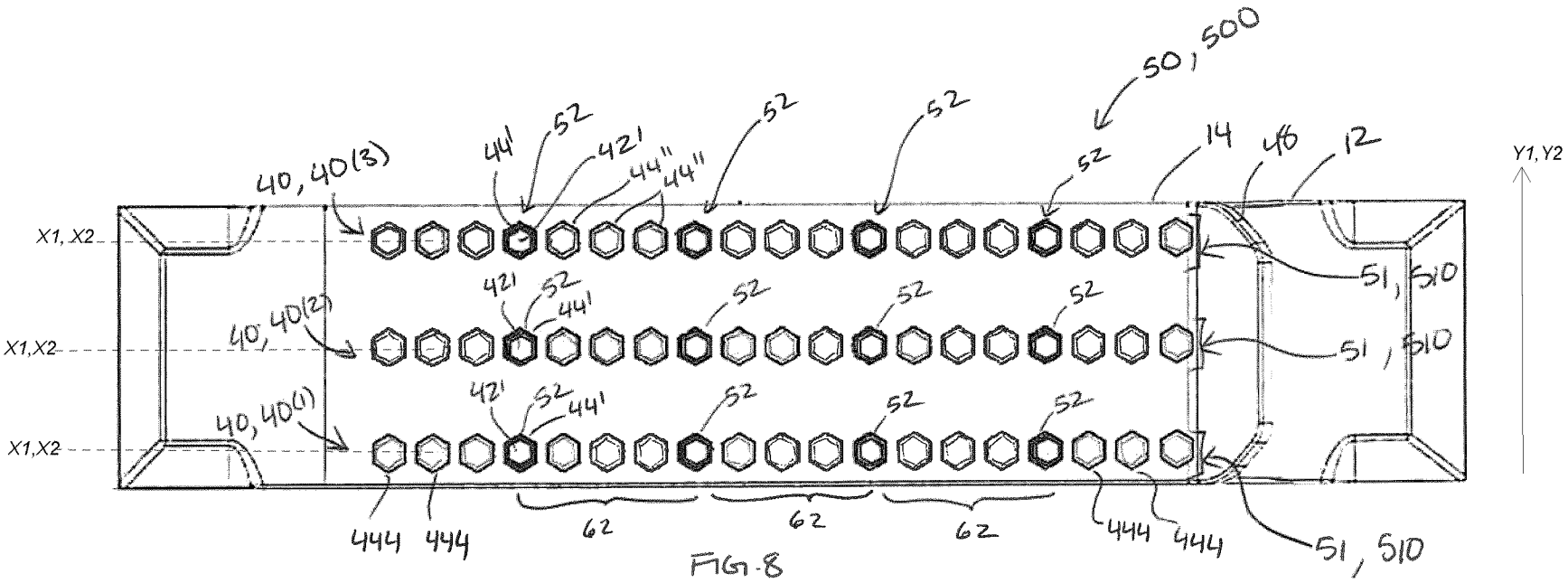
FIG. 8 is a plan view of the fastener of FIG. 1 in one of a plurality of connected configurations.
Figure 9:
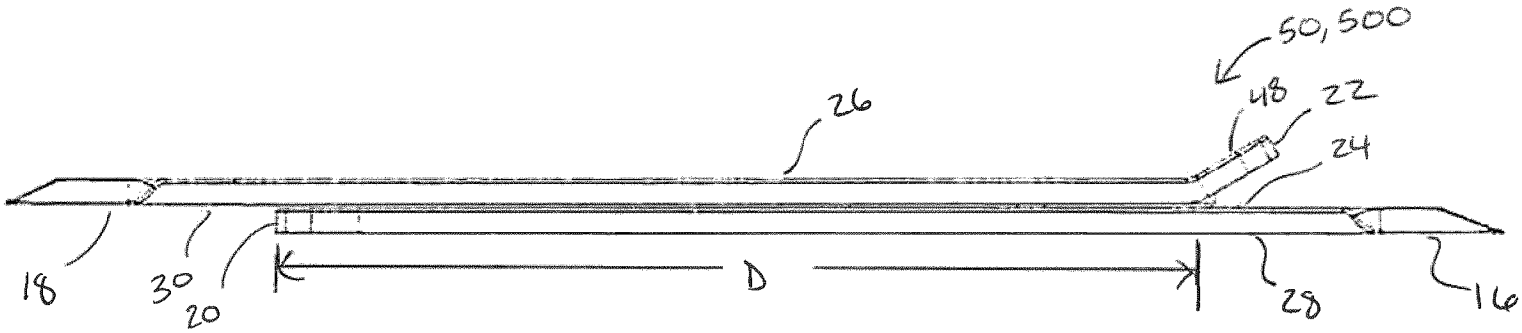
FIG. 9 is a side elevation view of the fastener of FIG. 8.

Referring now to FIGS. 8 and 9, the first fastener counterpart 12 and the second fastener counterpart 14 are co-operatively configured for connection in a plurality of connected configurations 50. For each one of the plurality of connected configurations 50, independently, the second fastener counterpart 14 overlaps the first fastener counterpart 12 such that at least a portion of the surface of the second side 30 of the second fastener counterpart 14 is disposed in face-to-face relationship with at least a portion of the surface of the first side 24 of the first fastener counterpart 12.

For each one of the plurality of connected configurations 50, independently, the extent of the overlap, D, is different relative to the extent of overlap of every other one of the other connected configurations 50.

In some example embodiments, for instance, when the fastener 10 is incorporated into an article of clothing 100, such as an adjustable cap 1100, each one of the connected configurations 50, independently, is associated with a size of opening, defined by the article of clothing 100, that is configured for receiving the body part of a user, or wearer. Accordingly, it will be understood that the size of opening associated with one connected configuration 50 is different than the size of opening associated with every other one of the plurality of connected configurations 50.

In some embodiments, for example, each one of the co-operating connection systems 40, independently, is configurable in a plurality of connected connection system configurations 51. Therefore, for each one of the co-operating connection systems 40, independently, each one of the plurality of connected connection system configurations 51, independently, includes at least one releasably coupled relationship 52. Each releasably coupled relationship 52, independently, is defined by releasable coupling between a participating one of the first interlocking counterparts 42' and a participating one of the second interlocking counterparts 44' of the respective connection system 40 of the plurality of connection systems 40.

In some embodiments, for example, the releasable coupling between a participating one of the first interlocking counterparts 42' and a participating one of the second interlocking counterparts 44' is defined by emplacement of the protrusion 32 of the participating first interlocking counterpart 42' within the receiver 34 of the participating one of the second interlocking counterparts 44'. In some embodiments, for example, the releasable coupling between a participating one of the first interlocking counterparts 42' and a participating one of the second interlocking counterparts 44' is such that the protrusion 32, of the participating one of the first interlocking counterparts 42', extends through the aperture of a participating one of the second interlocking counterparts 44'.

In some embodiments, for example, the releasable coupling between a participating one of the first interlocking counterparts 42' and a participating one of the second interlocking counterparts 44', such that a relasably coupled relationship 52 is established, includes a snap fit engagement that is established in response to extension of the protrusion 32 of the participating one of the first interlocking counterparts 42' through the aperture or receiver 34 of a participating one of the second interlocking counterparts 44'. In some embodiments, the first interlocking counterparts 42' and the second interlocking counterparts 44' are specifically sized and cooperatively configured such that the releasable coupling between a participating one (or ones) of the first interlocking counterparts 42' and a participating one (or ones) of the second interlocking counterparts 44' in a snap fit engagement is such that when the first and second fastener counterparts 12, 14 are releasably coupled in a connected configuration 50, the connection produces an audible "snap" or other sound that alerts the user or provides confirmation that the releasable coupling of the first fastener counterpart 12 to the second fastener counterpart 14 in the connected configuration has been effected. In example embodiments wherein the second interlocking counterpart 44 is an aperture 43 having a stepped profile, as described above, and the first interlocking counterparts 42 have a post-and-head configuration where the head 35 at the distal end of the post 33 has a diameter (or width) that this larger than the diameter (or width) of the post 33, the squeezing of the head 35 of the first interlocking counterpart 42 through the first portion 45 of the stepped profile aperture 43, and the subsequent release of the head 35 of the first interlocking counterpart 42 into the second portion 45 of the aperture 43, gives rise to the snap-fit engagement between the participating first interlocking counterpart 42' and the participating second interlocking counterpart 44' and provides audible confirmation that the first and second fastener counterparts 12, 14 have been releasably coupled in a connected configuration.

In some embodiments, for example, for each one of the co-operating connection systems 40, independently, the plurality of connected connection system configurations 51, include at least one multi-coupled connected configuration 510. Each multi-coupled connected configuration 510 of the plurality of connected connection system configurations 51, independently, defines a multi-coupled connected configuration 500 of the fastener 10. An example multi-coupled connected configuration 500 of the fastener 10 is illustrated in FIGS. 8-9.

As shown in the example embodiment of FIGS. 8-9, for each one of the multi-coupled connected configurations 510, independently, the at least one releasably coupled relationship 52 is "N" releasably coupled relationships, wherein "N" is an integer that is greater than or equal to two (2). The "N" releasably coupled relationships 52 includes "N−1" adjacent pairs of releasably coupled relationships 62. Therefore, for the example embodiment illustrated in FIG. 8, the multi-coupled connected configuration 510 of each of the co-operating connection systems 40 includes four (4) releasably coupled relationships 52, and three (3) adjacent pairs of releasably coupled relationships 62.

Figure 10:
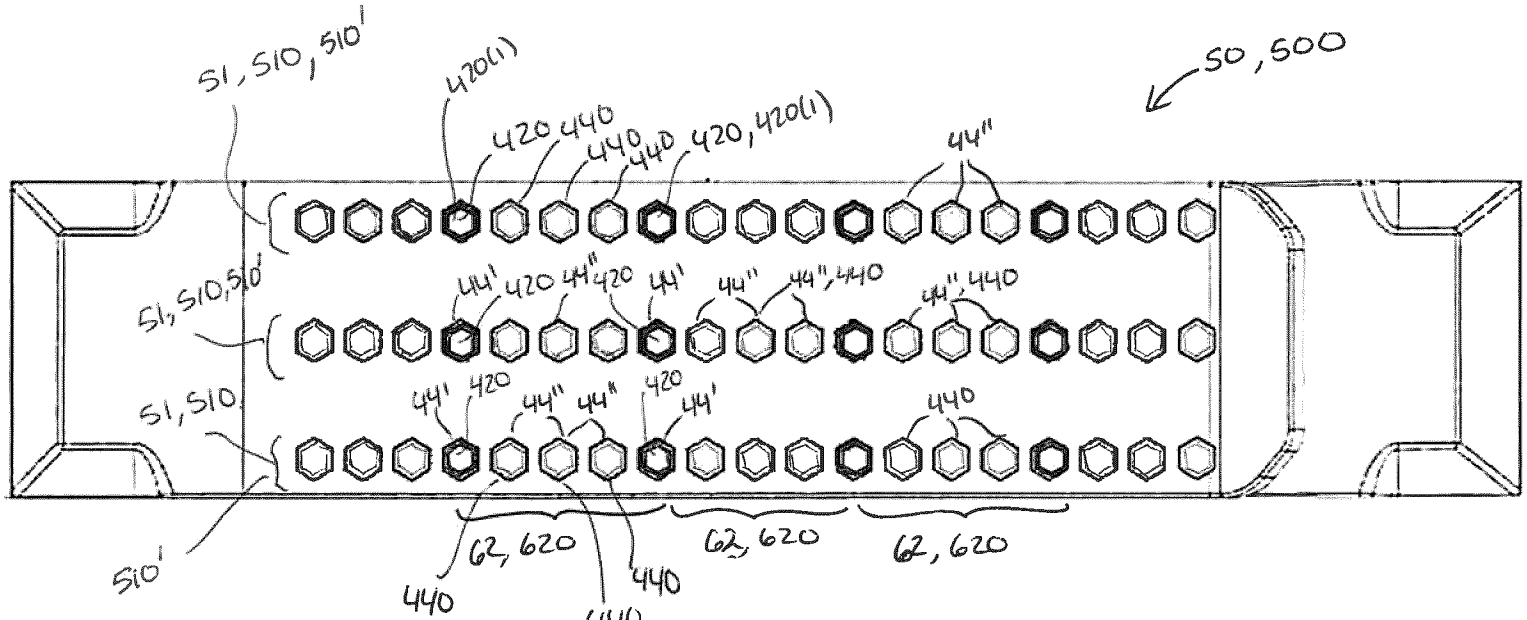
FIG. 10 is a plan view of the fastener of FIG. 1 in multi-coupled connected configuration.

With reference now to FIG. 10, it will be understood that each one of the multi-coupled connected configurations 510, independently, is an operative multi-coupled connected configuration 510'. In each one of the operative multi-coupled connected configurations 510', independently, the "N−1" adjacent pairs of releasably coupled relationships 62 are operative adjacent pairs of releasably coupled relationships 620. For each one of the operative adjacent pairs of releasably coupled relationships 620, independently, at least one non-participating second interlocking counterpart 44", of the second interlocking counterparts 44, is disposed between the participating second interlocking counterparts 44' of the operative adjacent pair 620. In the subject example embodiment, three non-participating second interlocking counterparts 44" are disposed between the participating second interlocking counterparts 44' of each of the operative adjacent pairs 620. Accordingly, it will be understood that the non-participating second interlocking counterparts 44" are those ones of the plurality of second interlocking counterparts 44 for which there is an absence of releasable coupling to one of the first interlocking counterparts 42.

As well, for each one of the operative adjacent pairs of releasably coupled relationships 620, each one of the participating first interlocking counterparts 42' of the operative adjacent pair 620, independently, is an operative participating first interlocking counterpart 420. Similarly, each one of the at least one non-participating second interlocking counterpart 44" that is disposed between the participating second interlocking counterparts 44' of the operative adjacent pair 620, independently, is an operative non-participating second interlocking counterpart 440. Furthermore, it will be understood that, while the first fastener counterpart 12 and the second fastener counterpart 14 are disposed in an operative multi-coupled connected configuration 500', each one of the at least one operative non-participating second interlocking counterparts 440, independently, is disposed on the longitudinal axis X2 that is respective to the plurality of second interlocking counterparts 44 of the corresponding connection system 40, of the second fastener counterpart 14. Therefore, it will be understood that, for each one of the operative adjacent pairs of releasably coupled relationships 620, independently, the participating second interlocking counterparts 44' and the operative non-participating second interlocking counterparts 440 are disposed on the same longitudinal axis X2 that is respective to the plurality of second interlocking counterparts 44 of the corresponding connection system 40, of the second fastener counterpart 14. Furthermore, it will be understood that in an operative multi-coupled connected configuration 500', for each one of the operative adjacent pairs of releasably coupled relationships 620, independently, there is an absence of a non-participating first interlocking counterpart between the operative participating first interlocking counterparts 420 of the operative adjacent pair 620.

In some embodiments, for example, it will be understood that the plurality of first interlocking counterparts 42 on the first fastener counterpart 12, and the plurality of second interlocking counterparts 44 on the second fastener counterpart 14, are cooperatively configured, such that, while the fastener 10 is disposed in any one of the plurality of connected configurations 50, each connected connection system configuration 51 of the co-operating connection systems 40 will include one or more participating second interlocking counterparts 44', and a plurality of non-participating second interlocking counterparts 44". The number of participating second interlocking counterparts 44' and the number of non-participating second interlocking counterparts 44" for each connected configuration 50 depend on the particular connected connection system configuration 51 associated with the particular connected configuration 50 of the fastener 10. In at least one of the multi-coupled connected configurations 500, some of the non-participating second interlocking counterparts 44" will include operative non-participating second interlocking counterparts 440, as well as non-operative, non-participating second interlocking counterparts 444. For the at least one multi-coupled connected configuration 500, each one of the non-operative, non-participating second interlocking counterparts 444, independently, is a non-participating second interlocking counterpart 44" that is disposed other than between the participating second interlocking counterparts 44' of an operative adjacent pair of releasably coupled relationships 620.

Accordingly, in some embodiments, for example, it will be understood that, the plurality of first interlocking counterparts 42 are disposed on the first fastener counterpart 12 such that the number of first interlocking counterparts 42 is less than the number of second interlocking counterparts 44 disposed on the second fastener counterpart 14. In some embodiments, for example, the plurality of first interlocking counterparts 42 includes a total number "X" of first interlocking counterparts, wherein "X" is an integer that is greater than or equal to two (2), while the plurality of second interlocking counterparts 44 includes a total number "Y" of second interlocking counterparts, wherein "Y" is an integer that is greater than "X". In some embodiments, for example, the ratio of "Y" to "X" is at least 3:2. In some embodiments, for example, the integer "X" is a minimum of two (2) and a maximum of seven (7). In some embodiments, for example, the integer "Y" is a minimum of three (3) and a maximum of twenty five (25). However, it will be understood that the exact number of first interlocking counterparts 42 and the exact number of second interlocking counterparts 44 in each of the co-operating connection systems 40 will depend on the overall size, configuration and intended application of the fastener 10. Furthermore, as will be described in further detail below in reference to the example embodiments illustrated in FIGS. 19-21, the number of first interlocking counterparts 42 in at least some of the co-operating connection systems 40 may be different than the number of first interlocking counterparts 42 provided in other ones of the plurality of co-operating connection systems 42.

Figure 2:
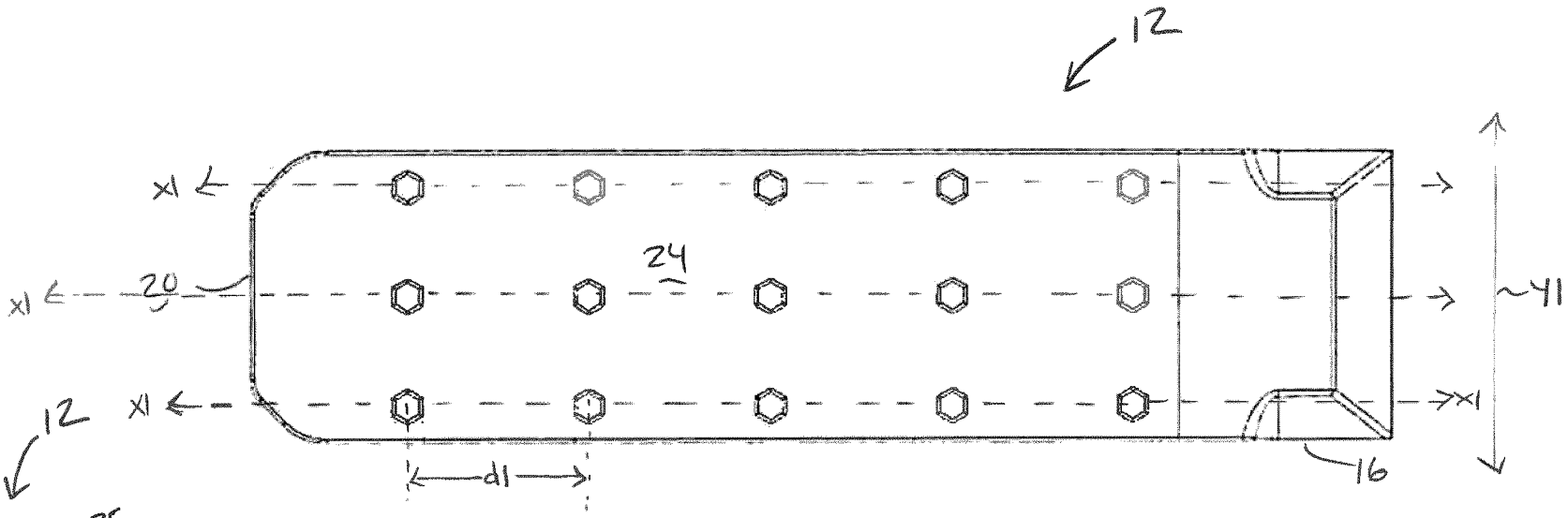
FIG. 2 is a plan view of a first fastener counterpart of the fastener of FIG. 1 in isolation.
Figure 5:
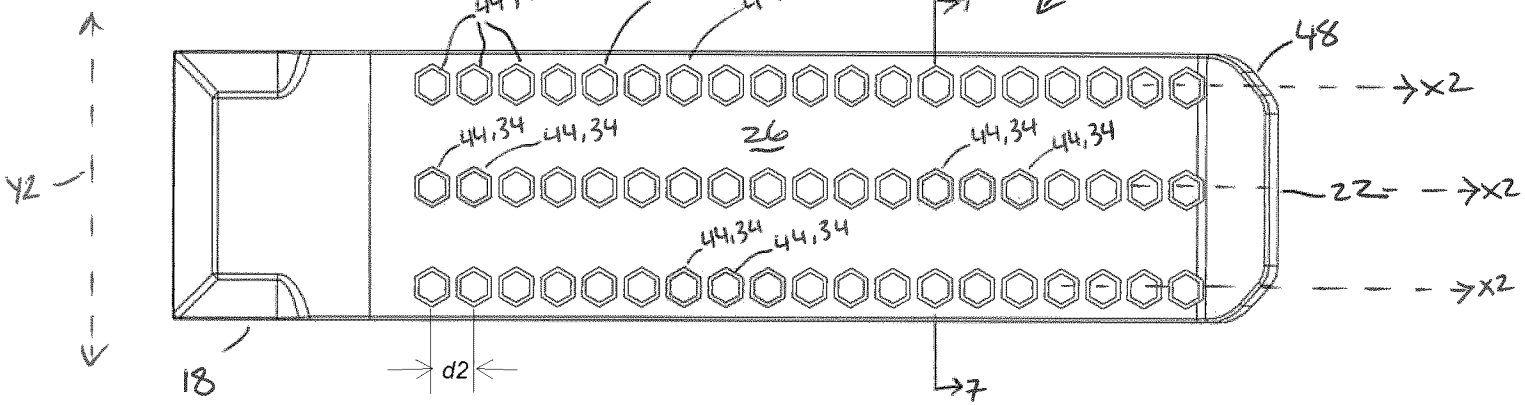
FIG. 5 is a plan view of a second fastener counterpart of the fastener of FIG. 1 in isolation.
Figure 6:
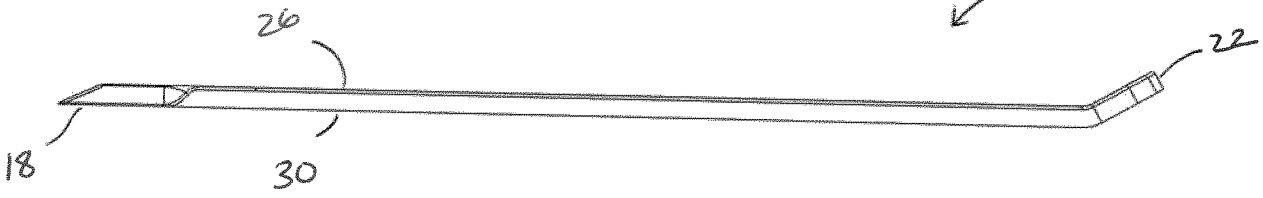
FIG. 6 is a side elevation view of the second fastener counterpart of FIG. 5.

Referring now to FIGS. 2 and 5, in some embodiments, for example, for each one of the plurality of cooperating connection systems 40, the plurality of first interlocking counterparts 42 are disposed along the longitudinal axis X1, of the first fastener counterpart 12, that is respective to the cooperating connection system 40, such that adjacent ones of the plurality of first interlocking counterparts 42 are spaced apart from each other by a distance d1 that is greater than a distance d2 by which each pair of adjacent ones of the plurality of second interlocking counterparts 44 are spaced apart from each other along the longitudinal axis X2, of the second fastener counterpart 14, that is respective to the co-operating connection system 40. In some embodiments, for example, the distance d1 by which adjacent ones of the plurality of first interlocking counterparts 42 are spaced apart from each other is measured center-to-center between adjacent ones of the plurality of first interlocking counterparts 42 along the corresponding longitudinal axis X1. In some embodiments, for example, the distance d1 by which adjacent ones of the plurality of first interlocking counterparts 42 are spaced apart from each other is the same for each pair of adjacent ones of the plurality of first interlocking counterparts 42. In some embodiments, for example, the distance d2 is measured centre-to-centre between adjacent second interlocking counterparts 44, along the corresponding longitudinal axis X2 of the second fastener counterpart 14.

In some embodiments, for example, the distance d2, measured centre-to-centre between adjacent ones of the plurality of second interlocking counterparts 44, is from a minimum of 3 mm to a maximum of 12 mm. In other embodiments, for example, the distance d2, measured centre-to-centre between adjacent ones of the plurality of second interlocking counterparts 44, is from a minimum of 4 mm to a maximum of 7 mm. In some embodiments, for example, the distance d2, measured centre-to-centre between adjacent ones of the plurality of second interlocking counterparts 44 is 5 mm. In some embodiments, for example, the distance d2, measured centre-to-centre between adjacent ones of the plurality of second interlocking counterparts 44 is from a minimum of 3.175 mm (e.g. ⅛ in) to a maximum of 9.525 mm (e.g. ⅜ in). In some embodiments, for example, the distance d2, measured centre-to-centre between adjacent ones of the plurality of second interlocking counterparts 44 is from a minimum of 3.175 mm (e.g. ⅛ in) to a maximum of 6.35 mm (e.g. ⅜ in). In example embodiments where the fastener 10 is incorporated into an adjustable cap or hat, in some embodiments, the distance d2, measured centre-to-centre between adjacent ones of the plurality of second interlocking counterparts 44, is 3.175 mm (e.g. ⅛ in), the fastener 10 thereby allowing adjustment of the hat size in increments of ⅛ in which corresponds to the difference between typical, conventional fitted hat sizes.

In some embodiments, for example, the distance d1, measured centre-to-centre between adjacent ones of the plurality of first interlocking counterparts 42 is at least 12.7 mm. However, it will be understood that the distance, d1, as measured center-to-centre between adjacent ones of the plurality of first interlocking counterparts 42, will be a multiple of the distance d2 by which the second interlocking counterparts 44 are spaced apart, wherein the multiple is an integer that is greater than or equal to two (2).

In some embodiments, for example, the second fastener counterpart 14 is configured such that the second, free end portion 22 of the second fastener counterpart 12 includes a tab portion 48 that extends at an angle relative to the plane of the second fastener counterpart 14. In some embodiments, for example, the tab portion 48 facilitates release of the second fastener counterpart 14 from the first fastener counterpart 12 such that a connected configuration 50 is defeated. In some embodiments, for example, the tab portion 48 is disposed at an angle relative to the plane of the surface of the face 30 of the second fastener counterpart 14 such that disposition of the first and second fastener counterparts 12, 14 in any one of the plurality of connected configurations 50 is such that the tab portion 48 extends out of the plane of contact between the first face 24 of the first fastener counterpart 12 and the second face 30 of the second fastener counterpart 14. In some embodiments, for example, the tab portion 48 extends out of the plane of contact between the first face of the first fastener counterpart 12 and the second face of the second fastener counterpart 14 by an angle, a. In some embodiments, for example, the angle, a, that the tab portion 48 extends out of the plane of contact between the first face of the first fastener counterpart 12 and the second face of the second fastener counterpart 14 is from a minimum of 15 degrees to a maximum of 45 degrees. In some embodiments, for example, the angle, a, that the tab portion 48 extends out of the plane of contact between the first face of the first fastener counterpart 12 and the second face of the second fastener counterpart 14 is from a minimum of 22.5 degrees to a maximum of 37.5 degrees. In some embodiments, for example, the angle, a, that the tab portion 48 extends out of the plane of contact between the first face of the first fastener counterpart 12 and the second face of the second fastener counterpart 14 is 30 degrees. Accordingly, in some embodiments, the tab portion 48 provides a gripping portion for a user to grasp the second fastener counterpart 12 and pull the second fastener counterpart 14 away from the first fastener counterpart 12 such that the releasable coupling between the participating first interlocking counterparts 42' and the second interlocking counterparts 44' is defeated. Additionally, in some embodiments, for example, the tab portion 48 may provide some clearance between the second fastener counterpart 14 and the first fastener counterpart 12 in instances where the fastener 10 is disposed in a connected configuration 50 wherein a non-participating first interlocking counterpart 42 would otherwise interfere with the second fastener counterpart 14 being disposed in an overlapping relationship to establish a connected configuration 50.

Figure 6B:
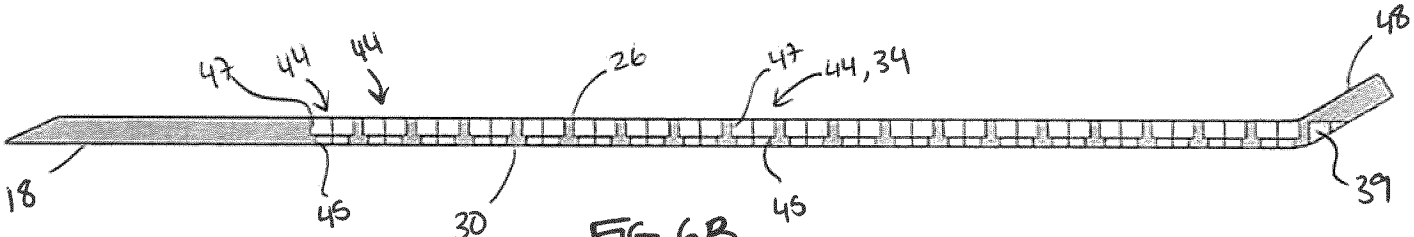
FIG. 6B is a cross-sectional view of the second fastener counterpart of FIG. 6 taken along a central, longitudinal axis of the second fastener counterpart.
Figure 6A:
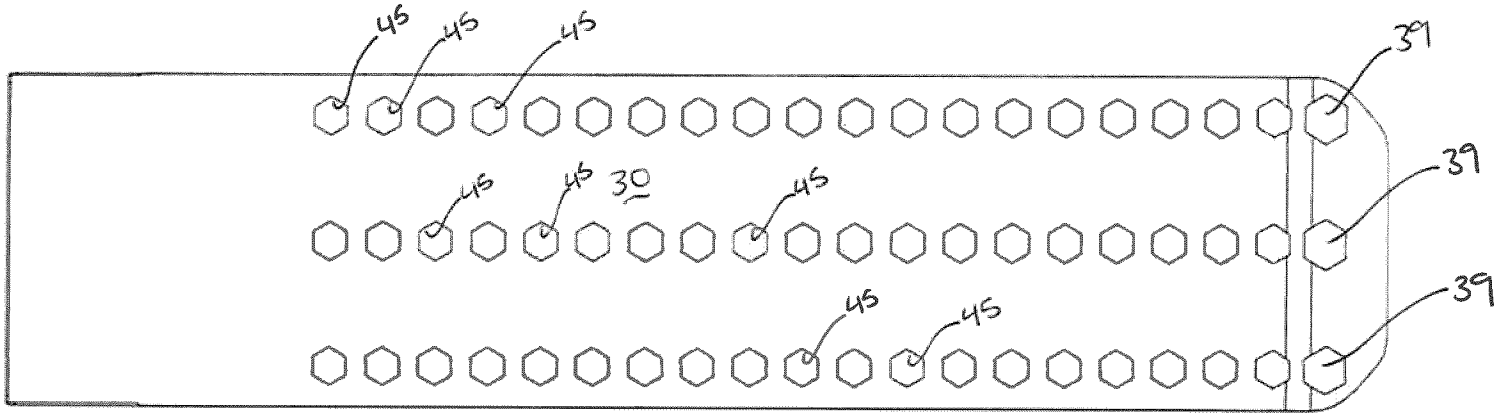
FIG. 6A is a rear plan view of the second fastener counterpart of FIG. 5.

Referring in particular to FIGS. 6A and 6B, in some embodiments, for example, in order to prevent potential interference between the tab portion 48 of the second fastener counterpart 14 and one or more non-participating first interlocking counterparts 42 that are disposed most proximal to the tab portion 48, the tab portion 48 includes recesses 49 that extend into the second fastener counterpart 14 from the second side or second surface 30. Each recess 39, independently, allows for at least a portion of a non-participating first interlocking counterpart 42 associated with each co-operating connection system 40 to be received within or at least partially received, or partially embedded, within the corresponding recess 39 that is respective to the corresponding co-operating connection system 40.

Use of the fastener 10 for adjusting the size of an opening will now be described in further detail with reference to the various example connected configurations illustrated in FIGS. 11-14. In some embodiments, for example, the plurality of connected configurations 50 of the fastener 10 include a first connected configuration 50(1), wherein the first connected configuration 50(1) is a multi-coupled connected configuration 500 where the co-operating connection systems 40 are each disposed in an operative multi-coupled connected configuration 510'.

Figures 11, 12:
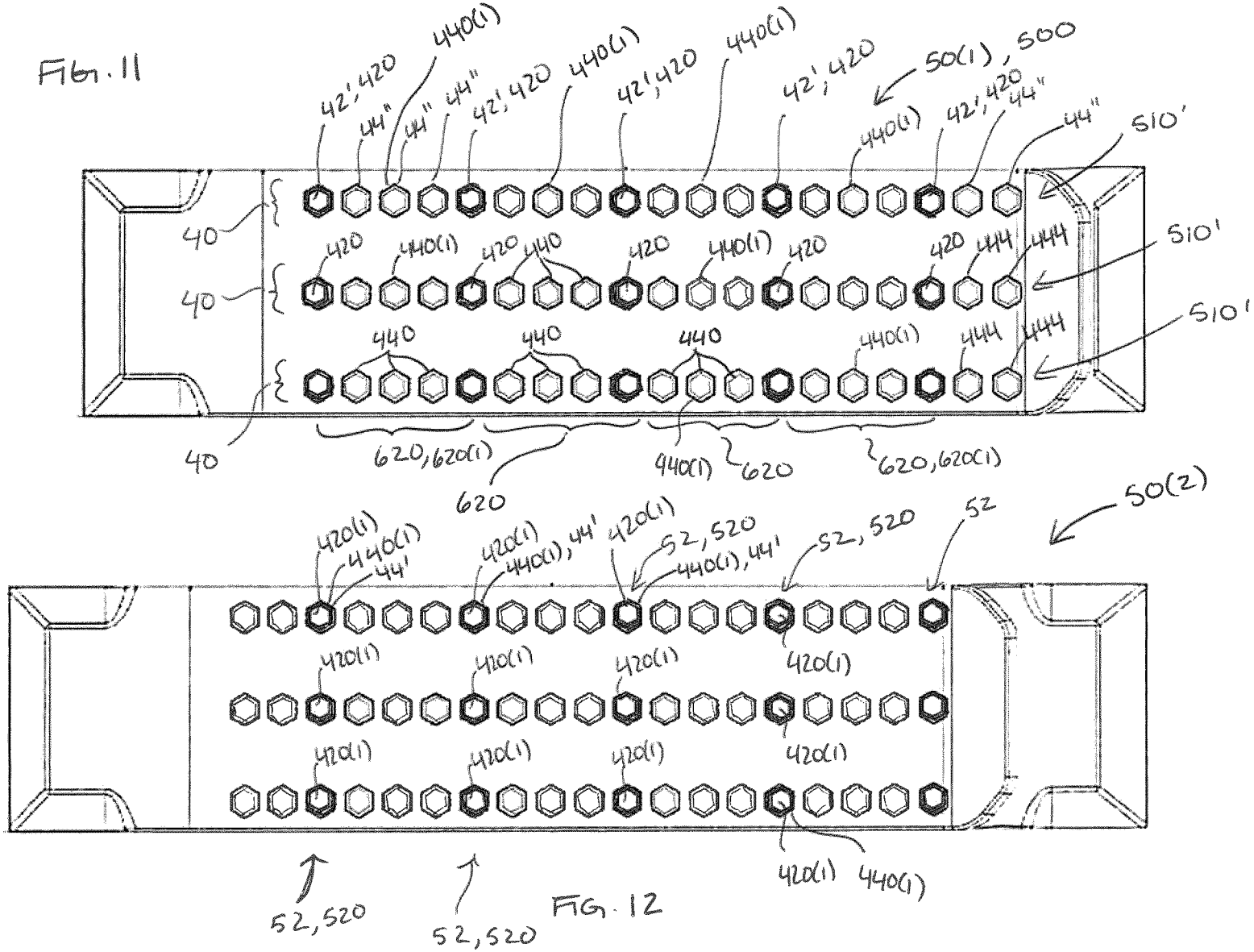
FIG. 11 is a plan view of the fastener of FIG. 1 in an example embodiment of a first connected configuration of the plurality of connected configurations.
FIG. 12 is a plan view of the fastener of FIG. 11 in an example embodiment of a second connected configuration of the plurality of connected configurations.
Figure 11A:
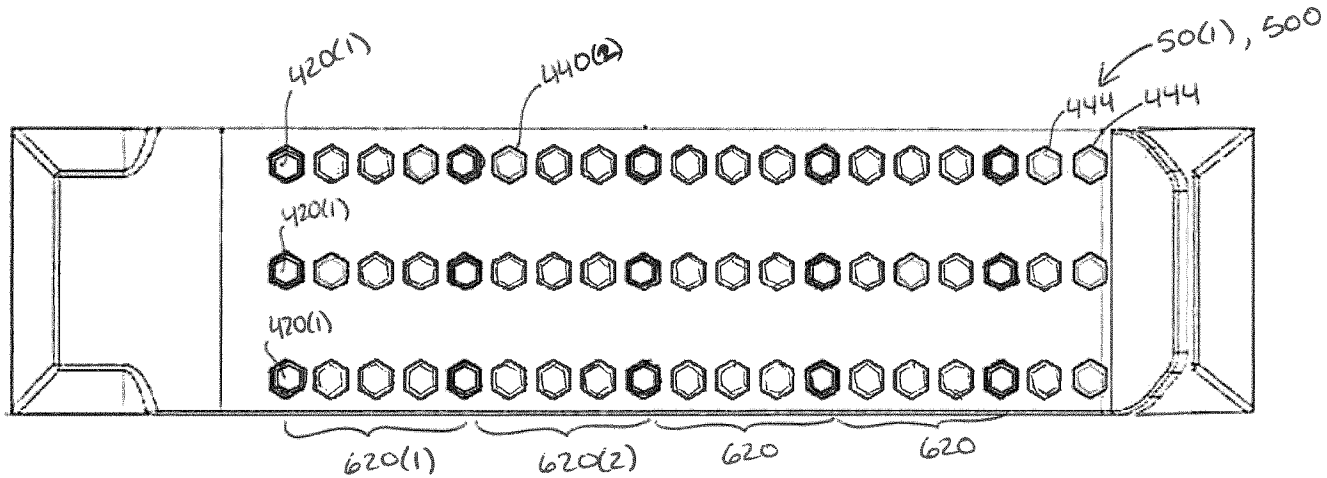
FIG. 11A is a plan view of the fastener of FIG. 1 in an example embodiment of a first connected configuration of the plurality of connected configurations.

In the first connected configuration 50(1), for each one of the co-operating connection systems 40, a plurality of the first interlocking counterparts 42 are participating first interlocking counterparts 42' and a plurality of the second interlocking counterparts 44 are non-participating second interlocking counterparts 44" for which there is an absence of coupling with a first interlocking counterpart 42. An example embodiment of a first connected configuration 50(1) is illustrated in FIG. 11.

For each one of the operative adjacent pairs of releasably coupled relationships 620 that defines the operative multi-coupled connected configuration 510', the plurality of the participating first interlocking counterparts 42' are operative participating first interlocking counterparts 420 with, for example, three operative non-participating second interlocking counterparts 440 disposed between the are operative non-participating second interlocking counterpart 440 operative participating first interlocking counterparts 420 of each operative adjacent pair 620. In the subject example embodiment, two non-operative, non-participating second interlocking counterparts 444 are disposed most proximal to the second, distal end portion of the second fastener counterpart 14. It will be understood, however, that in other embodiments, there may be fewer operative non-participating second interlocking counterparts 440 or more operative non-participating second interlocking counterpart 440 disposed between the participating second interlocking counterparts 44' than what is shown in the example embodiment illustrated in FIG. 11.

While the first fastener counterpart 12 and the second fastener counterpart 14 are disposed in the first connected configuration 50(1), the participating first interlocking counterparts 42' are releasable from the corresponding participating second interlocking counterparts 44' such that the first connected configuration 50(1) is defeated with effect that the second fastener counterpart 14 is released from the first fastener counterpart 12 and becomes disposed for re-connection to the first fastener counterpart 12 in at least another one of the plurality of connected configurations 50, for example, a second connected configuration 50(2). An example embodiment of a second connected configuration 50(2) is illustrated in FIG. 12.

Re-connection of the second fastener counterpart 14 to the first fastener counterpart 12 in the second connected configuration 50(2) is such that another at least one releasably coupled relationship 52 is established, wherein, the another at least one releasably coupled relationship 52 is an operative releasably coupled relationship 520 that is defined, at least, by a releasable coupling between one of the operative participating first interlocking counterparts 420(1) of the first connected configuration 50(1) and one of the operative non-participating second interlocking counterparts 440(1) of the first connected configuration 50(1). Accordingly, at least one of the operative non-participating second interlocking counterparts 440 of the first connected configuration 50(1) becomes a participating second interlocking counterpart 44' of the second connected configuration 50(2). In some embodiments, for example, the second connected configuration 50(2) is another multi-coupled connected configuration 500, as shown for instance in FIG. 12. In some embodiments, for example, the operative releasably coupled relationship 520 established by the re-connection of the second fastener counterpart 14 to the first fastener counterpart 12 in a second connected configuration is such that the operative releasably coupled relationship 520 is defined by releasable coupling between one of the operative participating first interlocking counterparts 420(1) of one of the operative adjacent pairs 620(1) of the first connected configuration 50(1) and one of the operative non-participating second interlocking counterparts 440(1) associated with the same operative adjacent pair 620(1) defined by the first connected configuration 50(1). This relationship is illustrated in the example embodiment of FIGS. 11 and 12 as the fastener 10 transitions from the first connected configuration 50(1) in FIG. 11 to the second connected configuration 50(2) in FIG. 12.

In some embodiments, for example, the operative releasably coupled relationship 520 established by the re-connection of the second fastener counterpart 14 to the first fastener counterpart 12 in a second connected configuration 50(2) (see FIG. 12A), from a first connected configuration 50(1) (see FIG. 11A), is such that the operative releasably coupled relationship 520 is defined by releasable coupling between one of the operative participating first interlocking counterparts 420(1) of one of the operative adjacent pairs 620(1) the first connected configuration 50(1) and one of the operative non-participating second interlocking counterparts 440(2) associated with a different operative adjacent pair 620(2) as illustrated, for example, in the transitioning between configurations as illustrated in FIGS. 11A to 12A.

Figure 12A:
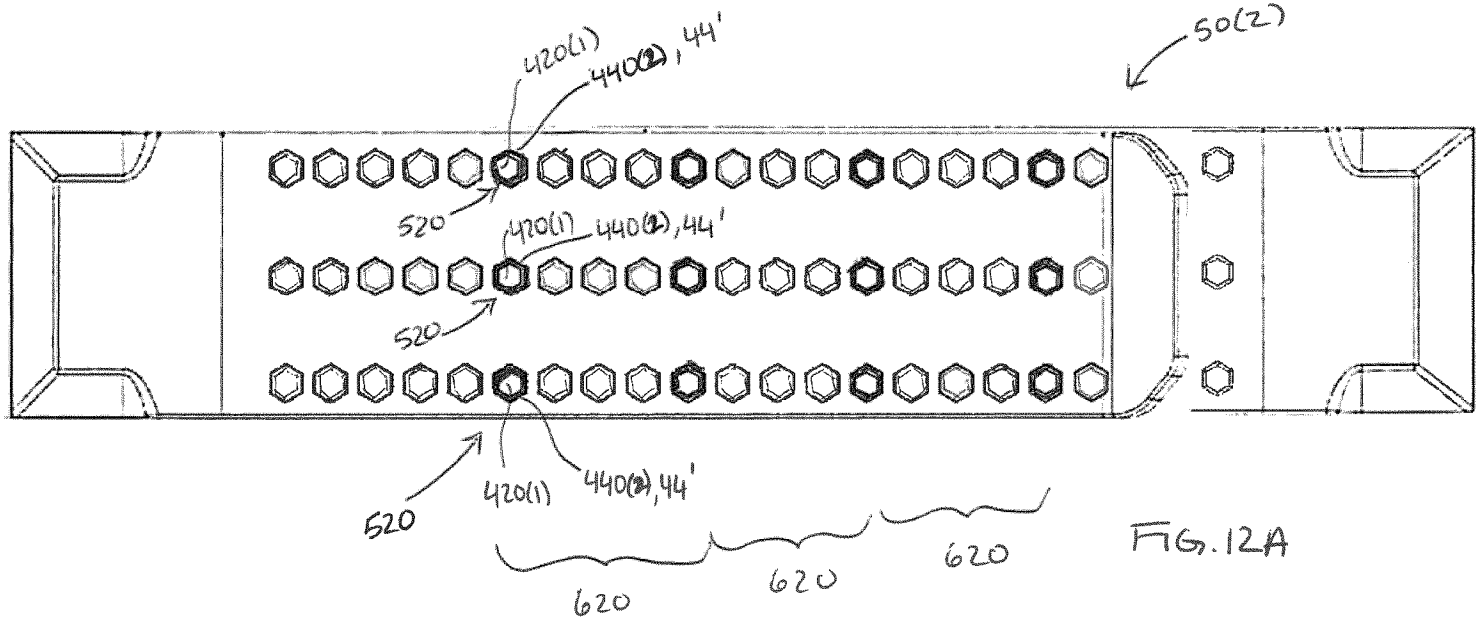
FIG. 12A is a plan view of the fastener of FIG. 11A in an example embodiment of a second connected configuration of the plurality of connected configurations.

The re-connection of the second fastener counterpart 14 to the first fastener counterpart 12 from the first connected configuration 50(1) to the second connected configuration 50(2) is with effect that the extent of the overlap between the second fastener counterpart 14 and the first fastener counterpart 12 is changed. In the example embodiments illustrated in FIGS. 11 and 12, and also FIGS. 11A and 12A, the transition of the fastener 10 from the first connected configuration 50(1), illustrated in FIG. 11 or 11A, to the example second connected configuration 50(2), illustrated in FIG. 12 or 12A, is with effect that the extent of overlap, D, between the second fastener counterpart 14 and the first fastener counterpart 12 is decreased. In other embodiments, for example, the re-connection of the second fastener counterpart 14 to the first fastener counterpart 12 in the second connected configuration 50(2) is with effect that the extent of the overlap between the second fastener counterpart 14 and the first fastener counterpart 12 increases.

Figure 13:
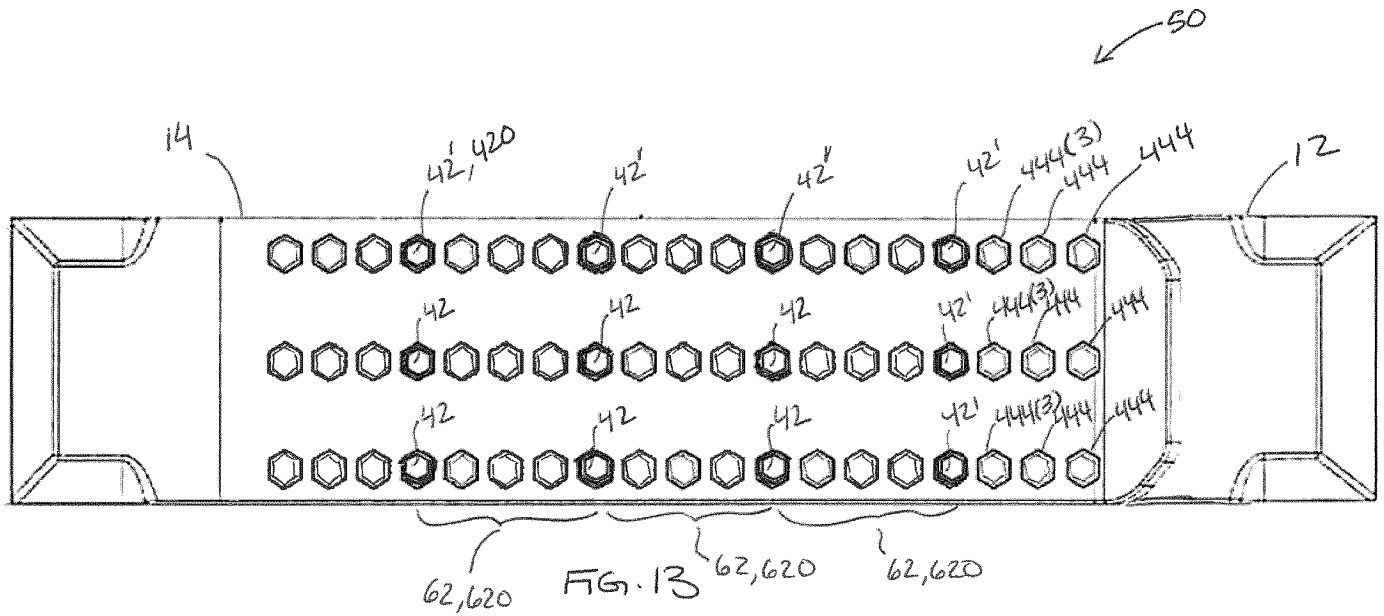
FIG. 13 is a plan view of the fastener of FIG. 1 in an example embodiment of a connected configuration of the plurality of connected configurations.
Figure 14:
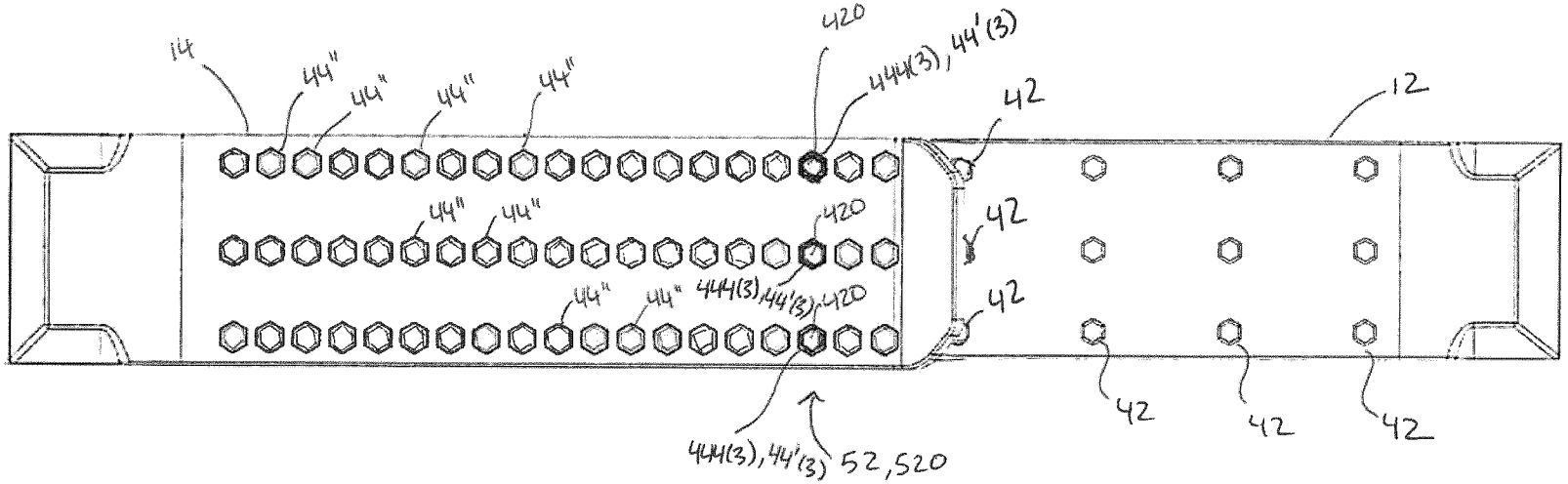
FIG. 14 is a plan view of the fastener of FIG. 13 disposed in an example embodiment of a third connected configuration of the plurality of connected configurations.

In some embodiments, for example, when the fastener 10 is disposed in one of the plurality of connected configurations 50, for example the connected configuration 50 illustrated in FIG. 13, the second fastener counterpart 14 is released from the first fastener counterpart 12, such that the connected configuration 50 is defeated, with effect that the second fastener counterpart 14 becomes disposed for re-connection to the first fastener counterpart 12 in another one of the plurality of connected configurations 50, wherein the another one of the plurality of connected configurations 50 is a third connected configuration 50(3). An example embodiment of a third connected configuration 50(3) is illustrated in FIG. 14. In such example embodiment, the participating first interlocking counterparts 42' are released from the corresponding participating second interlocking counterparts 44' such that connected configuration 50 is defeated, and the second fastener counterpart 14 becomes disposed for re-connection to the first fastener counterpart 12 in the third connected configuration 50(3), wherein, for at least one of the releasably coupled relationships 52, the releasable coupling is a releasable coupling between one of the operative participating first interlocking counterparts 42', 420 and one of the non-operative, non-participating second interlocking counterparts 444(3) of previous connected configuration 50, such that the previous non-participating second interlocking counterpart 444(3) becomes a participating second interlocking counterpart 44"(3) of the third connected configuration 50(3). An example embodiment of a third connected configuration 50(3) is illustrated, for instance, in FIG. 14. The re-connection of the second fastener counterpart 14 to the first fastener counterpart 12 in the third connected configuration 50(3) is with effect that only a single releasably coupled relationship 52 is established (as shown for instance in FIG. 14), while in other embodiments, for example, the re-connection of the second fastener counterpart 14 to the first fastener counterpart 12 in a third connected configuration 50(3) is with effect that another multi-coupled configuration is established.

In some embodiments, for example, the re-connection of the second fastener counterpart 14 to the first fastener counterpart 12 in the third connected configuration 50(3) is with effect that the extent of the overlap between the second fastener counterpart 14 and the first fastener counterpart 12 is changed. In some embodiments, for example, the re-connection of the second fastener counterpart 14 to the first fastener counterpart 12 in the third connected configuration 50(3) is with effect that the extent of the overlap between the second fastener counterpart 14 and the first fastener counterpart 12 increases. In some embodiments, for example, the re-connection of the second fastener counterpart 14 to the first fastener counterpart 12 in the third connected configuration 50(3) is with effect that the extent of the overlap between the second fastener counterpart 14 and the first fastener counterpart 12 decreases. In the example embodiments illustrated in FIGS. 13 and 14, the transition of the fastener 10 from the connected configuration 50 illustrated in FIG. 13 to the example third connected configuration 50(3) illustrated in FIG. 14 is with effect that the extent of overlap between the between the second fastener counterpart 14 and the first fastener counterpart 12 is decreased. In embodiments, where the fastener is incorporated into an article of clothing 100, for instance a hat, the transition of the fastener 10 from the connected configuration 50 illustrated in FIG. 13 to the example third connected configuration 50(3) illustrated in FIG. 14 is with effect that the size of the opening for receiving a body part, such as head, would be increased for a larger fit.

When the fastener 10 is incorporated into an article of clothing 100, for example, the plurality of connected configurations 50 each correspond to a different sized opening associated with the article of clothing 100. For instance, when the fastener 10 is incorporated into an article of clothing 100 and is disposed in a connected configuration 50 defined by only a single releasably coupled relationship 52 between a participating first interlocking counterpart 42' and a participating second interlocking counterpart 44' disposed proximal to the second free end portions 20, 22 of the corresponding first or second fastener counterpart 12, 14, for instance as shown in FIG. 14, the size of opening of the article of clothing 100 would generally correspond to the largest size or largest defined opening associated with the article of clothing. As the extent of the overlap between the second fastener counterpart 14 and the first fastener counterpart 12 is increased and the second free end portion 22 of the second fastener counterpart is brought closed to the first end or article-engaging portion of the first fastener counterpart 12, the size of the opening associated with the article of clothing 100 is decreased. In other embodiments, for example, the first and second fastener counterparts 12, 14 may be disposed in a connected configuration 50 having only one releasably coupled relationship 52 wherein the one releasably coupled relationship 52 is established by the releasable coupling of the first interlocking counterpart 42 that is disposed in closest proximity to the article-engaging portion or first end portion 16 of the first fastener counterpart 12 with one of the second interlocking counterparts 44 disposed most proximal to the article-engaging portion 18 of the second fastener counterpart 14. In such example embodiment, the fastener 10 is disposed in one of the plurality of connected configurations that provides one of the smallest size openings for the article of clothing 100 into which the fastener 10 may be incorporated.

Figure 19:
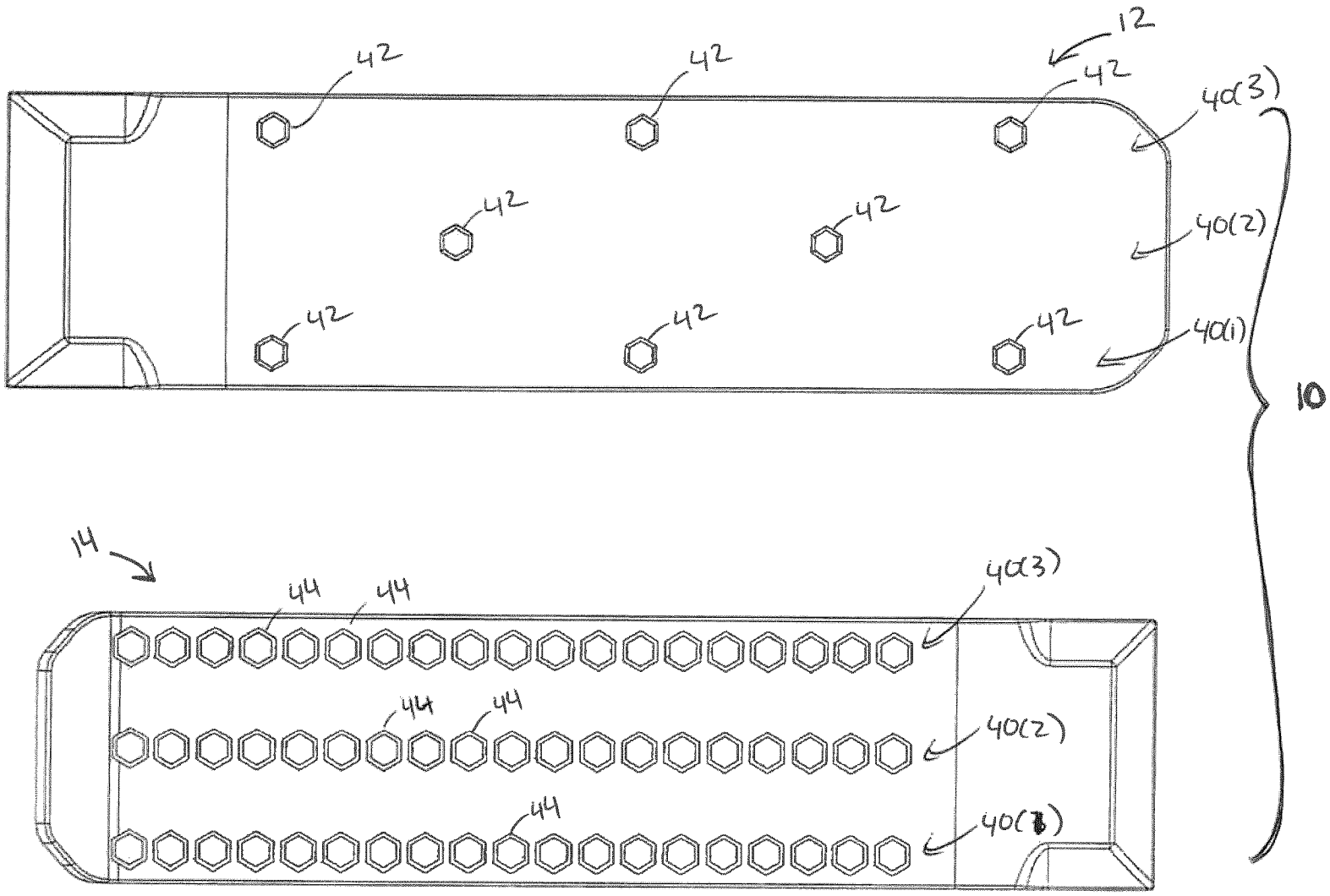
FIG. 19 is a plan view of a fastener according to another example embodiment of the present disclosure in an open or un-connected configuration.
Figure 20:
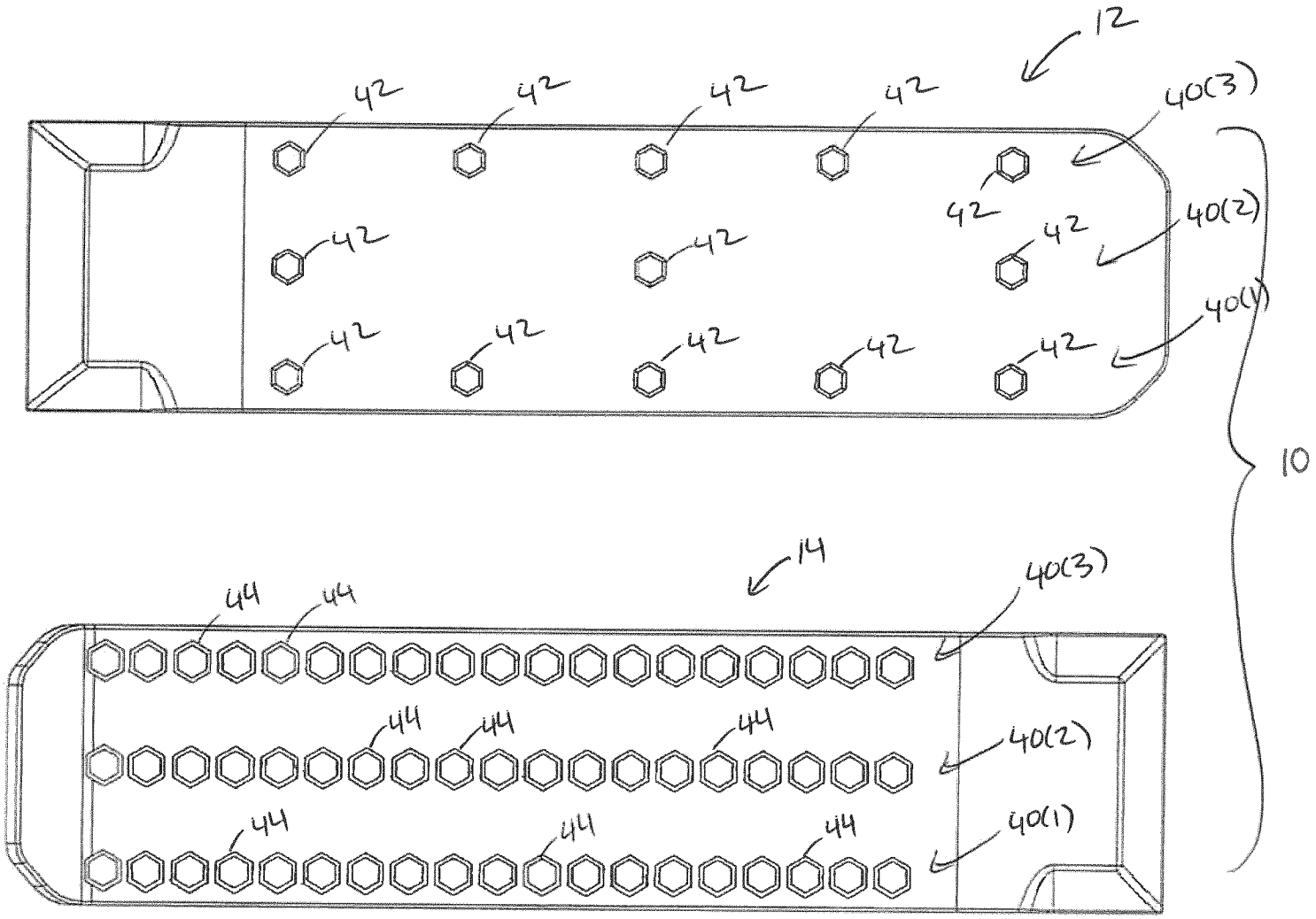
FIG. 20 is a plan view of a fastener according to another example embodiment of the present disclosure in an open or un-connected configuration.
Figure 21:
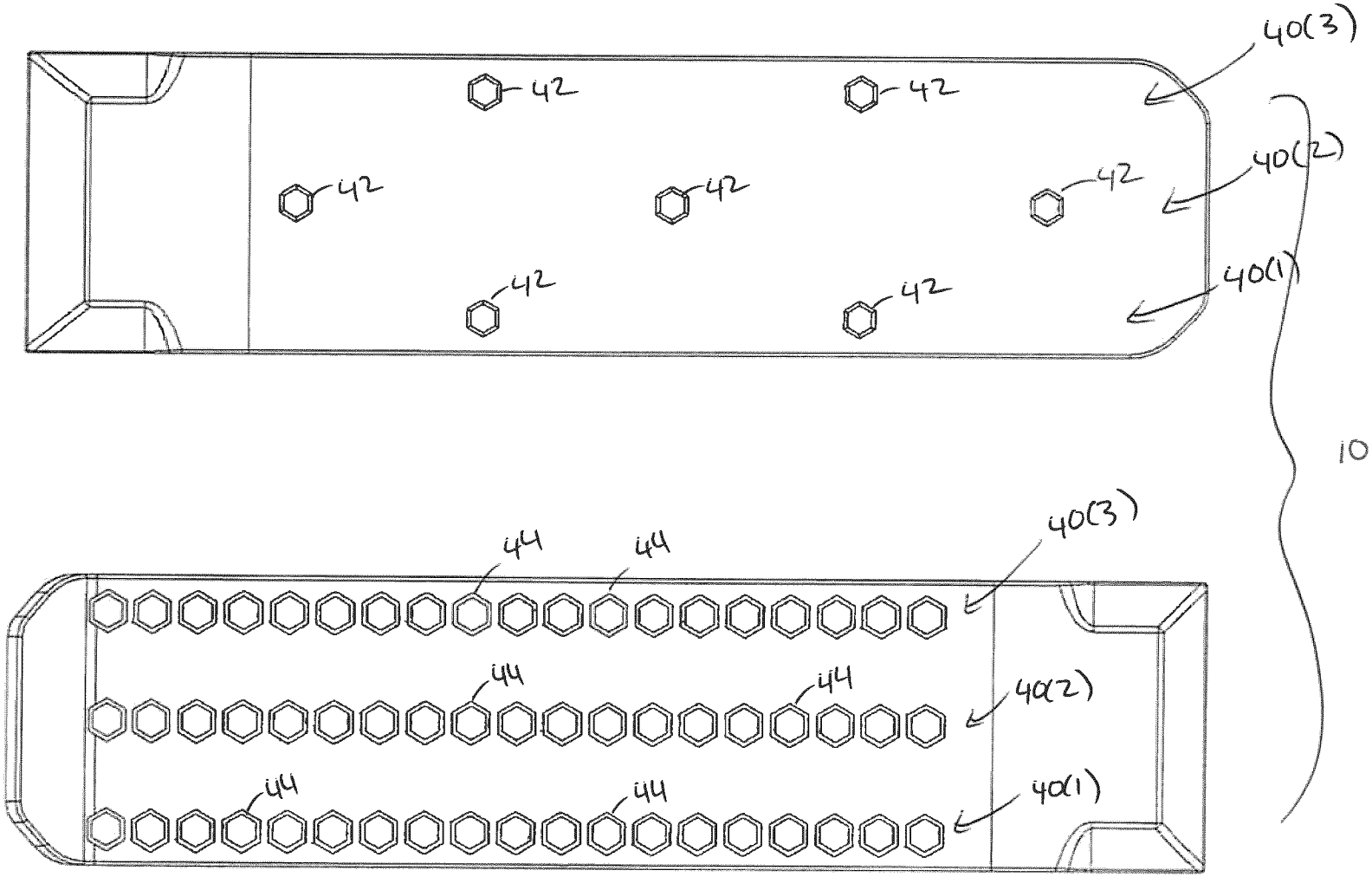
FIG. 21 is a plan view of a fastener according to another example embodiment of the present disclosure in an open or un-connected configuration.

Referring now to FIGS. 19-21, there are shown alternate example embodiments of the fastener 10 according to the present disclosure. As shown, rather than having all of the co-operating connection systems 40 the same as is illustrated in the example embodiments of FIGS. 1-14, in some embodiments, the co-operating connection systems 40 may be arranged differently such that for each connected configuration 50 of the fastener 10 at least some of the co-operating connection systems 40 are disposed in a different connected connection system configuration 510 as compared to the other co-operating connection systems 40 of the fastener 10. More specifically, in some embodiments, for example, the plurality of first interlocking counterparts 42 that are respective to a particular co-operating connection system 40, for instance a first co-operating connection system 40(1), are disposed along the longitudinal axis X1 that is respective to the first co-operating connection system in a first pattern that is different than the pattern in which the plurality of first interlocking counterparts 42 of another one of the co-operating connection systems, for instance, a second co-operating connection system 40(2), are arranged.

In the example embodiment illustrated in FIG. 19, the first co-operating connection system 40(1) and the third co-operating connection system 40(3) are identical with the plurality of first interlocking counterparts 42 being arranged in the same pattern along the longitudinal axis of the first fastener counterpart 12 that is respective to the co-operating connection system 40, while the second co-operating connection system 40(2) includes a plurality of first interlocking counterparts 42 that are arranged in a different pattern along the respective longitudinal axis of the first fastener counterpart 12 as compared to the first and third co-operating connection systems 40(1), 40(3). Accordingly, in some of the plurality of connected configurations 50 of the fastener 10, only some of the co-operating connection systems 40, for instance the first and third co-operating connection systems 40(1), 40(3), are disposed in a multi-coupled connected configuration while others, for instance the second co-operating connection system 40(2) are disposed in a connected connection system configuration that includes only a single releasably coupled relationship. FIG. 20 illustrates a variation of the example embodiment illustrated in FIG. 19 where, once again, the first and third co-operating connection systems 40(1), 40(3) have first interlocking counterparts 42 disposed in a first pattern along the respective longitudinal axis while the second so-operating connection system 40(2) has the plurality of first interlocking counterparts 42 disposed in a different pattern.

Referring now to FIG. 21 there is shown another example embodiment of a fastener 10 according to the present disclosure wherein the plurality of first interlocking counterparts 42 of the second co-operating connection system 40(2) are disposed along the respective longitudinal axis of the first fastener counterpart 12 in a pattern that differs from the pattern in which the plurality of first interlocking counterparts 42 of the first and third co-operating connection systems 40(1), 40(3) are arranged. In the subject example embodiment, it will be understood that in some of the plurality of connected configurations 50 of the fastener 10 the connection may be established by a single releasably coupled relationship in only one of the co-operating connection systems 40. However, for each one of the co-operating connection systems 40, independently, the plurality of connected connection system configurations 510 include at least one multi-coupled connected connection system configuration wherein at least one non-participating second interlocking counterpart 44 is disposed between the participating second interlocking counterparts 44 of an operative adjacent pair of releasably coupled relationship.

Accordingly, it will be understood that in some example embodiments, the fastener 10 includes first and second fastener counterparts 12, 14 that are co-operatively configured to define a plurality of co-operating connection systems 40 where each one of the plurality of co-operating connection systems 40, independently, includes a plurality of first interlocking counterparts 42 and a plurality of second interlocking counterparts 44 such that for each one of the co-operating connections systems, independently, the plurality of first interlocking counterparts are defined by the first fastener counterpart and disposed along a longitudinal axis, of the first fastener counterpart, that is respective to the co-operating connection system and the plurality of second interlocking counterparts are defined by the second fastener counterpart and disposed along a longitudinal axis, of the second fastener counterpart, that is respective to the co-operating connection system. The first fastener counterpart 12 and the second fastener counterpart 14 are co-operatively configured for connection in a plurality of connected configurations 50 wherein for each one of the plurality of connected configurations, independently, the second fastener counterpart overlaps the first fastener counterpart, the extent of the overlap is different relative to the overlap of every other one of the other connected configurations, and the connection is established by at least one releasably coupled relationship in at least one of the plurality of co-operating connection systems. Additionally, each one of the co-operating connection systems 40, independently, is configurable in a plurality of connected connection system configurations 50 where, for each one of the co-operating connection systems 40, independently, the plurality of connected connection system configurations include at least one multi-coupled connected configuration 500 as defined above in connection with the previously described embodiments wherein for each one of the at least one multi-coupled connected configuration, independently, the connection of the connected connection system configuration is established by "N" releasably coupled relationships, wherein "N" is an integer that is greater than or equal to two (2), the "N" releasably coupled relationships includes "N−1" adjacent pairs of releasably coupled relationships, the "N−1" adjacent pairs of releasably coupled relationships including at least one operative adjacent pair of releasably coupled relationships where, for each one of the at least one operative adjacent pair of releasably coupled relationships, independently, at least one non-participating second interlocking counterpart, of the second interlocking counterparts, is disposed between the participating second interlocking counterparts of the operative adjacent pair.

In other example embodiments, for each one of the co-operating connection systems, independently, the plurality of first interlocking counterparts 42 defined by the first fastener counterpart 12 and the plurality of second interlocking counterparts 44 defined by the second fastener counterpart 14 are arranged such that each one of the co-operating connection systems, independently, is configurable in a plurality of connected connection system configurations 500 where for at least one of the co-operating connection systems 40, independently, each one of the plurality of connected connection system configurations 500, independently, includes at least one releasably coupled relationship defined by releasable coupling between a participating one of the first interlocking counterparts 42 and a participating one of the second interlocking counterparts 44, the at least one of the co-operating connection systems 40 also being configurable in at least one multi-coupled connected configuration 510 as defined above. Accordingly, in some embodiments, it will be understood that not all of the co-operating connection systems 40 will have corresponding first and second interlocking counterparts 42, 44 that are arranged such that a multi-coupled connected configuration 510 with at least one non-participating second interlocking counterpart 44' disposed between the participating second interlocking counterparts of an operative adjacent pair.

Figure 15:
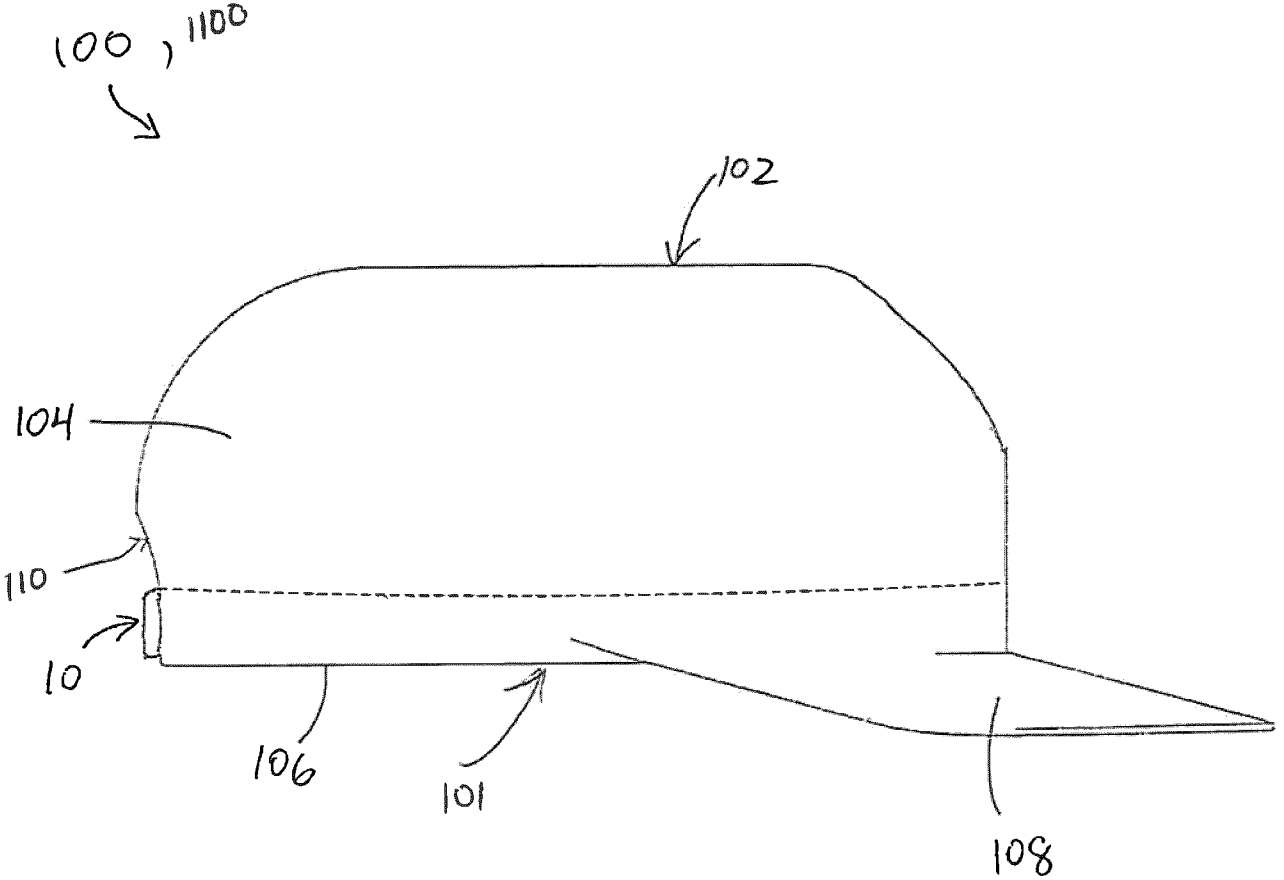
FIG. 15 is a perspective view of an adjustable cap with the fastener of FIGS. 1-13 incorporated therein.
Figure 16:
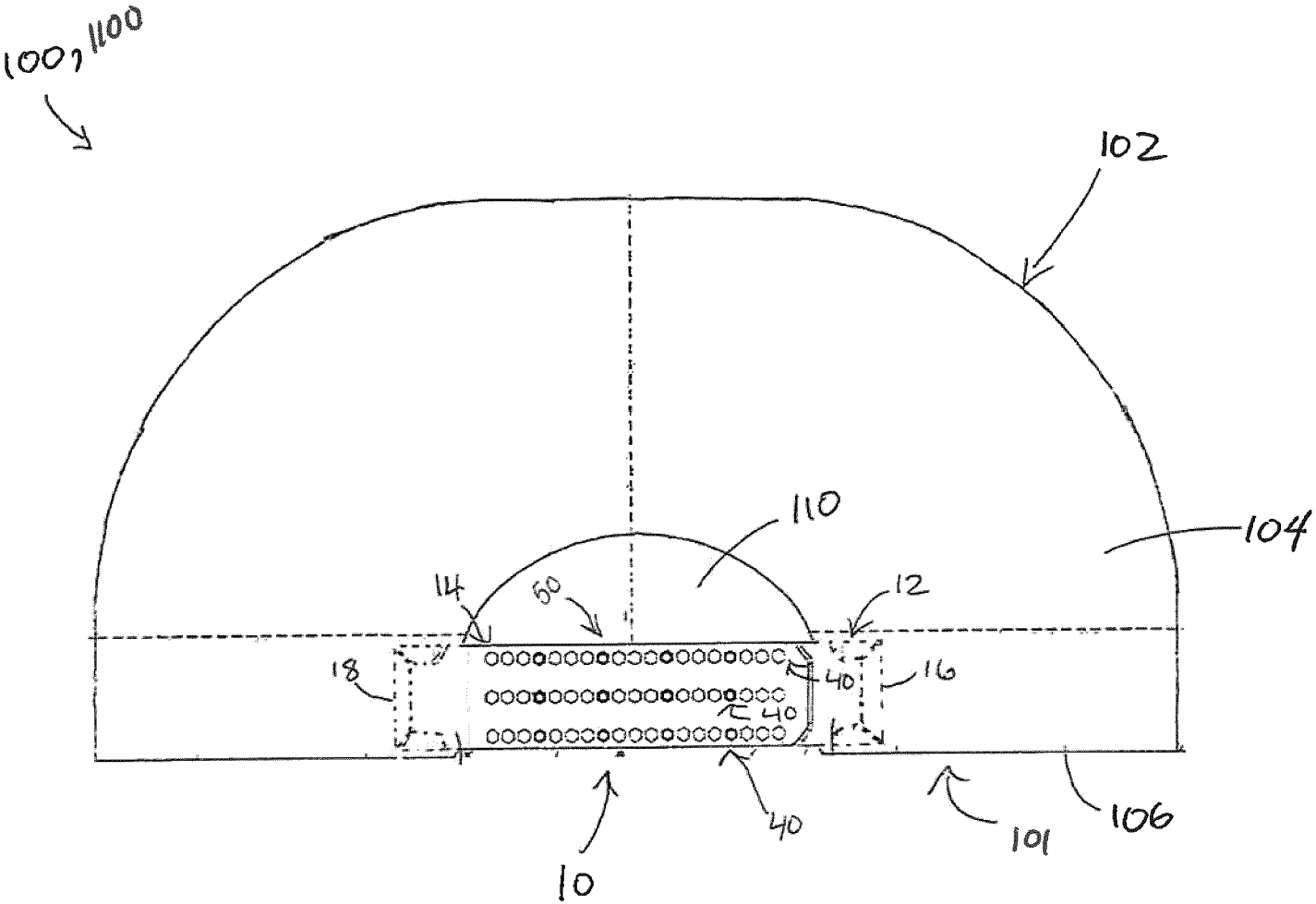
FIG. 16 is a back elevation view of the adjustable cap of FIG. 15.

Referring now to FIGS. 15-16, there is shown an example embodiment of an article of clothing 100 defining an opening 101 for receiving a human body part which includes the fastener 10 as described above in connection with FIGS. 1 to 14. In the subject example embodiment, the article of clothing 100 is in the form of a headwear article or an adjustable size cap or hat 1100 with opening 101 for receiving the head of the wearer, the article of clothing 100 or cap 1100 incorporating fastener 10. In such example embodiment, the fastener 10 enables the headwear article or cap 1100 to be adjusted to accommodate different sized heads of various wearers by adjusting the size of the opening 101 defined by the article of clothing cap 1100 to the circumference of the head of the wearer.

In the example embodiment of FIGS. 15-16, cap 1100 comprises a crown portion 102 with sidewalls 104 for residing over a wearer's head, with sidewalls 104 extending to a rim 106 having a circumference. In some embodiments, for example, cap 1100 further includes a visor 108 that extends from a front portion of the crown portion 102 with the sidewalls 104 defining an opening or cutout 110 positioned generally opposite to the visor 108, the opening or cutout 110 extending through the rim 106.

As shown in FIG. 16, for example, fastener 10 is incorporated into crown portion 102, such that the article-engaging portion 16 of the first fastener counterpart 12 is secured to sidewall 104 such that the second, free end portion 20 of the first fastener counterpart 12 extends into opening 110. Similarly, the article-engaging portion 18 of the second fastener counterpart 14 is also secured to sidewall 104 generally opposite to the first fastener counterpart 12 such that the second fastener counterpart 14 extends into opening 110 in an opposite direction as compared to the first fastener counterpart 12, the first and second fastener counterparts 12, 14 thereby being disposed for connection in a plurality of overlapping, connected configurations 50.

In some embodiments, for example, the first and second fastener counterparts 12, 14 are aligned along the circumference of the rim 106 defined by the sidewalls 104 of the cap 1100. In this manner, the first and second fastener counterparts 12, 14 are disposed for connection in a plurality of connected configurations 50, where each one of the plurality of connected configurations 50, independently defines a corresponding size of opening 101. Each corresponding size of opening 101 also defines, in some instances, a different sized opening 110 at the back of the cap 1100.

Accordingly, in some embodiments, for example, there is provided an article of clothing defining an opening for receiving a human body part, and including a fastener 10 for allowing adjustment to the size of the opening 101 wherein the fastener 10 includes a plurality of cooperating connection systems 40, wherein each connection system 40 includes a plurality of first interlocking counterparts 42, disposed along a longitudinal axis of the first fastener counterpart that is respective to the connection system 40, and a plurality of second interlocking counterparts 44, disposed along a longitudinal axis, of the second fastener counterpart that is respective to the connection system 40.

The first fastener counterpart 12 and the second fastener counterpart 14 are incorporated into the article of clothing 100 or cap 1100 such that the first fastener counterpart 12 and the second fastener counterpart 14 are cooperatively configured for connection in a plurality of connected configurations 50 wherein for each one of the plurality of connected configurations 50, independently, the second fastener counterpart 14 overlaps the first fastener counterpart 12 and the size of the opening defined by the article of clothing 100 is different than the corresponding opening of every other one of the connected configurations 50.

Disposition of the first fastener counterpart 12 and the second fastener counterpart 14 in one of the plurality of connected configurations 50 is such that the connection is defined by at least one releasably coupled relationship 22 within the cooperating connection systems 40. Each one of the at least one releasably coupled relationship 22, independently, is defined by releasable coupling between a participating one of the first interlocking counterparts 42' and a participating one of the second interlocking counterparts 44'. In some embodiments, for example, the connected configuration 50 is a multi-coupled connected configuration 500 that includes "N" releasably coupled relationships 52, wherein "N" is an integer that is greater than or equal to two (2), and the "N" releasably coupled relationships 52 includes "N−1" adjacent pairs of releasably coupled relationships 62. The "N−1" adjacent pairs of releasably coupled relationships 62 are operative adjacent pairs of releasably coupled relationships 620 wherein at least one non-participating second interlocking counterpart 44", of the plurality of second interlocking counterparts 44, is disposed between the participating second interlocking counterparts 42' of the operative adjacent pair 62.

Therefore, it will be understood that for each one of the plurality of connected configurations 50, independently, the size of the corresponding opening is different than the corresponding opening of every other one of the connected configurations 50, Therefore, while the first and second fastener counterparts 12, 14 are disposed in one of the plurality of connected configurations 50, the fastener is disposed in one of a plurality of closed positions corresponding to a particular size of opening 101.

In order to adjust the size of the article of clothing 100 or to adjust the size of the cap 1100 from one connected configuration 50 to another one of the connected configuration 50, the second fastener counterpart 14 is released from the first fastener counterpart 12 such that the connected configuration 50 of the fastener 10 is defeated, the second fastener counterpart 14 therefore becoming disposed for re-connection to the first fastener counterpart 12 in another one of the connected configurations 50, as described above in connection with FIGS. 8-14. Therefore, disposition of the first fastener counterpart 12 and the second fastener counterpart 14 in another one of the connected configurations 50 is with effect that the size of the opening 101 of the article of clothing 100 or cap 1100 is either increased or decreased, depending on whether the extent of the overlap between the first and second fastener counterparts 12, 14 is increased or decreased when the first and second fastener counterparts 12, 14 are connected in the other one of the plurality of connected configurations 50.

Since the first and second fastener counterparts 12, 14 may be coupled or releasably connected together in a large number of connected configurations 50 (or a large number of alternate closed positions), as a result of the increased number of second interlocking counterparts 40 provided on the second fastener counterpart 14 as compared to the number of first interlocking counterparts 42 provided on the first fastener counterpart 12, the size adjustment of the article of clothing 100 or the cap 1100 into which the fastener 10 is incorporated can be more finely tuned than the size adjustment available in conventional straps or fasteners used in other conventional caps, such as baseball caps, where the number of second interlocking counterparts 44 is generally the same as the number of first interlocking counterparts 42. Therefore, the fastener 10, as incorporated in to the article of clothing 100 or cap 1100 allows for smaller adjustments in the sizing of the circumference of crown portion 102 which, in turn, allows the article of clothing 100 or cap 1100 to be more finely adjusted to more accurately fit the body part of the user of the circumference of the wearer's head.

While various embodiments of fastener 10 and article of clothing 100 or adjustable cap 1100 have been described, it will be understood that certain adaptations and modifications of the described embodiments can be made. Therefore, the above discussed embodiments are considered to be illustrative and not restrictive.

What is claimed is:

1. A fastener, for incorporating into an article of clothing, for allowing size adjustment of the clothing, the fastener comprising:

a first fastener counterpart; and a second fastener counterpart;

wherein:

the first and second fastener counterparts are co-operatively configured to define a plurality of co-operating connection systems so that the first fastener counterpart and the second fastener counterpart are co-operatively configured for connection in a plurality of connected configurations;

each one of the plurality of co-operating connection systems, independently, includes a plurality of first interlocking counterparts and a plurality of second interlocking counterparts;

for each one of the plurality of co-operating connection systems, independently:

the plurality of first interlocking counterparts are defined by the first fastener counterpart and disposed along a longitudinal axis, of the first fastener counterpart, that is respective to one of the plurality of co-operating connection systems; and the plurality of second interlocking counterparts are defined by the second fastener counterpart and disposed along a longitudinal axis, of the second fastener counterpart that is respective to one of the plurality of co-operating connection systems, and that corresponds to the respective longitudinal axis of the first interlocking counterparts of the first fastener counterpart so that when the first fastener counterpart and the second fastener counterpart are disposed in one of the plurality connected configurations, the respective longitudinal axis of the first interlocking counterparts of the first fastener counterpart and the respective longitudinal axis of the second interlocking counterparts of the second fastener counterpart extend relative to one another so that a longitudinal axis that is respective to the one of the plurality of co-operating connection systems is established;

each one of the plurality of co-operating connection systems, independently, is configurable in a plurality of connected connection system configurations;

for each one of the plurality of co-operating connection systems, independently:

each one of the plurality of connected connection system configurations, independently, includes at least one releasably coupled relationship;

each one of the at least one releasably coupled relationship, independently, is defined by releasable coupling between a participating one of the first interlocking counterparts that is defined along the respective longitudinal axis of the first fastener counterpart and a participating one of the second interlocking counterparts that is defined along the respective longitudinal axis of the second fastener counterpart so that the at least one releasably coupled relationship is established along the longitudinal axis of the respective one of the co-operating connection systems that is established when the first fastener counterpart and the second fastener counterpart are disposed in a connected configuration;

the plurality of connected connection system configurations include at least one multi-coupled connected configuration; and for each one of the at least one multi-coupled connected configuration, independently:

the at least one releasably coupled relationship is "N" releasably coupled relationships, wherein "N" is an integer that is greater than or equal to two;

the "N" releasably coupled relationships includes "N−1" adjacent pairs of releasably coupled relationships;

at least one of the at least one multi-coupled connected configuration is an operative multi-coupled connected configuration, such that at least one operative multi-coupled connected configuration is provided; and for each one of the at least one operative multi-coupled connected configuration, independently:

the "N−1" adjacent pairs of releasably coupled relationships include at least one operative adjacent pair of releasably coupled relationships; and for each one of the at least one operative adjacent pair of releasably coupled relationships, independently:

at least one non-participating second interlocking counterpart, of the second interlocking counterparts, is disposed between the participating second interlocking counterparts of the operative adjacent pair;

each one of the participating first interlocking counterparts of the operative adjacent pair, independently, is an operative participating first interlocking counterpart; and each one of the at least one non-participating second interlocking counterpart that is disposed between the participating second interlocking counterparts of the operative adjacent pair, independently, is an operative non-participating second interlocking counterpart;

and the longitudinal axis that is respective to a one of the plurality of cooperating connection systems, when the first fastener counterpart and the second fastener counterpart are disposed in a connected configuration, is parallel to and spaced apart from the respective longitudinal axis of every other one of the plurality of co-operating connection systems.

2. The fastener as claimed in claim 1, wherein:

the article of clothing into which the fastener is configured for incorporation defines an opening for receiving a human body part, the fastener allowing size adjustment of the opening;

the first fastener counterpart includes an end portion configured for connection to a first edge portion of the article of clothing that defines a portion of a perimeter of the opening; and the second fastener counterpart includes an end portion configured for connection to a second edge portion of the article of clothing that defines a portion of a perimeter of the opening; and the first fastener counterpart and the second fastener counterpart are configured for connection to the article of clothing so that the first fastener counterpart is disposed opposite to the second fastener counterpart.

3. The fastener as claimed in claim 1, wherein:

for each one of the at least one operative adjacent pair of releasably coupled relationships, independently, there is an absence of a non-participating first interlocking counterpart between the participating first interlocking counterparts of the operative adjacent pair.

4. The fastener as claimed in claim 1, wherein:

for each one of the connected connection system configurations, independently, the non-participating second interlocking counterparts are those ones of the plurality of second interlocking counterparts of each one of the co-operating connection systems for which there is an absence of releasable coupling to a one of the first interlocking counterparts.

5. The fastener as claimed in claim 1, wherein:

for each one of the plurality of co-operating connection systems, independently, each one of the plurality of connected connection system configurations, independently, establishes one of the plurality of connected configurations of the first fastener counterpart and the second fastener counterpart.

6. The fastener as claimed in claim 1;

wherein:

for each one of the plurality of co-operating connection systems, independently:

the plurality of first interlocking counterparts are disposed along the longitudinal axis of the first fastener counterpart that is respective to the cooperating connection system such that adjacent ones of the plurality of first interlocking counterparts are spaced apart from each other by a first-interlocking counterpart distance; and the plurality of second interlocking counterparts are disposed along the longitudinal axis of the second fastener counterpart that is respective to the cooperating connection system such that adjacent ones of the plurality of second interlocking counterparts are spaced apart from each other by a second-interlocking counterpart distance;

the first-interlocking counterpart distance is greater than the second interlocking counterpart distance;

and the first-interlocking counterpart distance for each one of the plurality of cooperating connection systems is the same and the second interlocking counterpart distance for each one of the plurality of co-operating connection systems is the same.

7. The fastener as claimed in claim 1;

wherein:

for each one of the plurality of co-operating connection systems, independently:

the plurality of first interlocking counterparts are disposed along the longitudinal axis of the first fastener counterpart that is respective to the cooperating connection system such that adjacent ones of the plurality of first interlocking counterparts are spaced apart from each other by a first-interlocking counterpart distance; and the plurality of second interlocking counterparts are disposed along the longitudinal axis of the second fastener counterpart that is respective to the cooperating connection system such that adjacent ones of the plurality of second interlocking counterparts are spaced apart from each other by a second-interlocking counterpart distance;

the first-interlocking counterpart distance is greater than the second interlocking counterpart distance;

and the second interlocking counterpart distance for each one of the plurality of co-operating connection systems is the same; and the first-interlocking counterpart distance for at least one of the plurality of co-operating connection systems is different than the first-interlocking counterpart distance for other ones of the plurality of co-operating connection systems.

8. The fastener as claimed in claim 1;

wherein:

for each one of the plurality of connections systems, independently, the second interlocking counterparts are configured so that they are spaced apart along the longitudinal axis of the second fastener counterpart, that is respective to the one of the plurality of co-operating connection systems by a distance, as measured center-to-center between adjacent ones of the plurality of second interlocking counterparts along the longitudinal axis, of a minimum of 3.175 mm to a maximum of 9.525 mm.

9. The fastener as claimed in claim 8;

wherein:

the first fastener counterpart is made from a first fastener counterpart material;

the second fastener counterpart is made from a second fastener counterpart material;

and at least the second fastener counterpart material is polyethylene or a mixture comprising polyethylene and one or more other polymers.

10. The fastener as claimed in claim 9;

wherein:

the one or more other polymers include a polyolefin elastomer (POE) and/or ethylene-vinyl acetate.

11. The fastener as claimed in claim 9;

wherein:

the polyethylene is selected from the group consisting of: low-density polyethylene, high-density polyethylene, and a combination of low-density polyethylene and high-density polyethylene.

12. An article of clothing defining an opening for receiving a human body part, the article of clothing including a fastener for allowing adjustment to the size of the opening, the fastener comprising:

a first fastener counterpart coupled to a first edge portion of the article of clothing that defines a portion of the opening; and a second fastener counterpart coupled to a second edge portion of the article of clothing that defines a portion of the opening so that the first fastener counterpart and the second fastener counterpart are disposed opposite to one another;

wherein:

the first and second fastener counterparts are co-operatively configured to define a plurality of co-operating connection systems so that the first fastener counterpart and the second fastener counterpart are co-operatively configured for connection in a plurality of connected configurations;

each one of the plurality of co-operating connection systems, independently, includes a plurality of first interlocking counterparts and a plurality of second interlocking counterparts;

for each one of the plurality of co-operating connection systems, independently:

the plurality of first interlocking counterparts are defined by the first fastener counterpart and disposed along a longitudinal axis, of the first fastener counterpart, that is respective to one of the plurality of cooperating connection systems; and the plurality of second interlocking counterparts are defined by the second fastener counterpart and disposed along a longitudinal axis, of the second fastener counterpart, that is respective to one of the cooperating connection systems, and that corresponds to the respective longitudinal axis of the first interlocking counterparts of the first fastener counterpart so that when the first fastener counterpart and the second fastener counterpart are disposed in one of the plurality connected configurations, the respective longitudinal axis of the first interlocking counterparts of the first fastener counterpart and the respective longitudinal axis of the second interlocking counterparts of the second fastener counterpart extend relative to one another such that a longitudinal axis that is respective to the one of the plurality of co-operating connection systems is established;

each one of the plurality of co-operating connection systems, independently, is configurable in a plurality of connected connection system configurations;

for each one of the plurality of co-operating connection systems, independently:

each one of the plurality of connected connection system configurations, independently, includes at least one releasably coupled relationship;

each one of the at least one releasably coupled relationship, independently, is defined by releasable coupling between a participating one of the first interlocking counterparts that is defined along the respective longitudinal axis of the first fastener counterpart and a participating one of the second interlocking counterparts that is defined along the respective longitudinal axis of the second fastener counterpart so that the at least one releasably coupled relationship is established along the longitudinal axis of the respective one of the cooperating connection systems that is established when the first fastener counterpart and the second fastener counterpart are disposed in a connected configuration;

the plurality of connected connection system configurations include at least one multi-coupled connected configuration; and for each one of the at least one multi-coupled connected configuration, independently:

the at least one releasably coupled relationship is "N" releasably coupled relationships, wherein "N" is an integer that is greater than or equal to two;

the "N" releasably coupled relationships includes "N−1" adjacent pairs of releasably coupled relationships;

at least one of the at least one multi-coupled connected configuration is an operative multi-coupled connected configuration, so that at least one operative multi-coupled connected configuration is provided; and for each one of the at least one operative multi-coupled connected configuration, independently:

the "N−1" adjacent pairs of releasably coupled relationships include at least one operative adjacent pair of releasably coupled relationships; and for each one of the at least one operative adjacent pair of releasably coupled relationships, independently:

at least one non-participating second interlocking counterpart, of the second interlocking counterparts, is disposed between the participating second interlocking counterparts of the operative adjacent pair;

each one of the participating first interlocking counterparts of the operative adjacent pair, independently, is an operative participating first interlocking counterpart; and each one of the at least one non-participating second interlocking counterpart that is disposed between the participating second interlocking counterparts of the operative adjacent pair, independently, is an operative non-participating second interlocking counterpart; and the longitudinal axis that is respective to a one of the plurality of cooperating connection systems, when the first fastener counterpart and the second fastener counterpart are disposed in a connected configuration, is parallel to and spaced apart from the respective longitudinal axis of every other one of the plurality of co-operating connection systems.

13. The article of clothing as claimed in claim 12; wherein:

each one of the plurality of connected connection system configurations of the first counterpart and the second counterpart, independently, defines a size of the opening of the article of clothing; and transitioning the fastener from a one of the plurality of connected connection system configurations to a different one of the plurality of connected connection system configurations is effective for changing the size of the opening of the article of clothing.

14. The article of clothing as claimed in claim 12; wherein:

for each one of the at least one operative adjacent pair of releasably coupled relationships, independently, there is an absence of a non-participating first interlocking counterpart between the participating first interlocking counterparts of the operative adjacent pair.

15. The article of clothing as claimed in claim 12; wherein:

for each one of the connected connection system configurations, independently, the non-participating second interlocking counterparts are those ones of the plurality of second interlocking counterparts of each one of the co-operating connection systems for which there is an absence of releasable coupling to a one of the first interlocking counterparts.

16. The article of clothing as claimed in claim 12; wherein:

for each one of the plurality of co-operating connection systems, independently, each one of the plurality of connected connection system configurations, independently, is effective for changing the size of the opening of the article of clothing by a minimum of 3.175 mm to a maximum of 9.525 mm.

17. A fastener, for incorporating into an article of clothing, for allowing size adjustment of the clothing, the fastener comprising:

a first fastener counterpart including a plurality of sets of first interlocking counterparts, each set of first interlocking counterparts, independently, being disposed along a longitudinal axis of the first fastener counterpart that is respective to a one of the plurality of sets of first interlocking counterparts;

a second fastener counterpart including a plurality of sets of second interlocking counterparts, each set of second interlocking counterparts, independently, being disposed along a longitudinal axis of the second fastener counterpart that is respective to a one of the plurality of sets of second interlocking counterparts and corresponds to a corresponding one of the plurality of sets of first interlocking counterparts of the first fastener counterpart;

the first fastener counterpart and the second fastener counterpart are cooperatively configured for connection in a plurality of connected configurations;

wherein:

for each one of the plurality of connected configurations, independently:

the second fastener counterpart overlaps the first fastener counterpart;

the extent of the overlap is different relative to the overlap of every other one of the other connected configurations;

the connection is established by at least one releasably coupled relationship in at least: (i) a first corresponding set of first interlocking counterparts and second interlocking counterparts along a first longitudinal axis of the fasteners, while disposed in a connected configuration, and (ii) a second corresponding set of first interlocking counterparts and second interlocking counterparts along a second longitudinal axis of the fastener while disposed in the connected configuration, independently; and each one of the at least one releasably coupled relationship, independently, is established by releasable coupling between a participating one of the first interlocking counterparts and a participating one of the second interlocking counterparts;

the plurality of connected configurations include at least one multi-coupled connected configuration;

for each one of the at least one multi-coupled connected configuration, independently:

the at least one releasably coupled relationship is "N" releasably coupled relationships, wherein "N" is an integer that is greater than or equal to two;

the "N" releasably coupled relationships includes "N−1" adjacent pairs of releasably coupled relationships;

at least one of the at least one multi-coupled connected configuration is an operative multi-coupled connected configuration;

and for each one of the at least one operative multi-coupled connected configuration, independently:

the "N−1" adjacent pairs of releasably coupled relationships include at least one operative adjacent pair of releasably coupled relationships; and for each one of the at least one operative adjacent pair of releasably coupled relationships, independently:

at least one non-participating second interlocking counterpart, of the second interlocking counterparts, is disposed between the participating second interlocking counterparts of the operative adjacent pair;

each one of the participating first interlocking counterparts of the operative adjacent pair, independently, is an operative participating first interlocking counterpart; and each one of the at least one non-participating second interlocking counterpart that is disposed between the operative participating second interlocking counterparts of the operative adjacent pair, independently, is an operative non-participating second interlocking counterpart; and for each set of the plurality of sets of second interlocking counterparts, independently, the second interlocking counterparts are configured so that they are spaced apart along the longitudinal axis that is respective to the set of second interlocking counterparts by a distance, as measured center-to-center between adjacent ones of the plurality of second interlocking counterparts along the second fastener counterpart, of a minimum of 3.175 mm to a maximum of 9.525 mm.

18. The fastener as claimed in claim 17, wherein:

the plurality of connected configurations includes:

a first connected configuration, wherein the first connected configuration is a one of the at least one operative multi-coupled connected configuration;

in the first connected configuration:

a plurality of the first interlocking counterparts are participating first interlocking counterparts;

a plurality of the second interlocking counterparts are non-participating second interlocking counterparts;

for each one of the at least one operative adjacent pair of releasably coupled relationships, independently:

at least two of the plurality of the participating first interlocking counterparts are operative participating first interlocking counterparts; and at least one of the plurality of the non-participating second interlocking counterparts is an operative non-participating second interlocking counterpart;

the participating first interlocking counterparts are releasable from corresponding participating second interlocking counterparts such that the first connected configuration is defeated with effect that the second fastener counterpart is released from the first fastener counterpart and becomes disposed for re-connection to the first fastener counterpart in at least another one of the plurality of connected configurations, wherein the at least another one of the plurality of connected configurations includes a second connected configuration;

wherein:

in the second connected configuration:

at least one of the at least one releasably coupled relationship is an operative releasably coupled relationship;

for each one of at least one operative releasably coupled relationship, the releasable coupling is a releasable coupling between a one of the at least two operative participating first interlocking counterparts and a one of the at least one operative non-participating second interlocking counterpart.

19. The fastener as claimed in claim 18;

wherein:

the re-connection of the second fastener counterpart to the first fastener counterpart in the second connected configuration is with effect that another multi-coupled connected configuration is established.

20. The fastener as claimed in claim 18;

wherein:

the re-connection of the second fastener counterpart to the first fastener counterpart in the second connected configuration is with effect that the extent of the overlap between the second fastener counterpart and the first fastener counterpart is changed.

21. The fastener as claimed in claim 20;

wherein:

the plurality of non-participating second interlocking counterparts include at least one non-operative, non-participating second interlocking counterpart, and each one of the at least one non-operative, non-participating second interlocking counterpart, independently, is a non-participating second interlocking counterpart that is disposed along the second longitudinal axis and other than between the participating second interlocking counterparts of an operative adjacent pair;

the at least another one of the plurality of connected configurations includes a third connected configuration;

and in the third connected configuration:

for at least one of the at least one releasably coupled relationship, the releasable coupling is a releasable coupling between a one of the at least two operative participating first interlocking counterparts and a one of the at least one non-operative, non-participating second interlocking counterpart.

22. The fastener as claimed in claim 21, wherein:

the re-connection of the second fastener counterpart to the first fastener counterpart in the third connected configuration is with effect that another multi-coupled connected configuration is established.

23. The fastener as claimed in claim 21, wherein:

the re-connection of the second fastener counterpart to the first fastener counterpart in the third connected configuration is with effect that the extent of the overlap between the second fastener counterpart and the first fastener counterpart is changed.

24. The fastener as claimed in claim 17, wherein:

the plurality of connected configurations includes:

a first connected configuration, wherein the first connected configuration is a one of the at least one operative multi-coupled connected configuration;

in the first connected configuration:

a plurality of the first interlocking counterparts are participating first interlocking counterparts;

a plurality of the second interlocking counterparts are non-participating second interlocking counterparts;

for each one of the at least one operative adjacent pair of releasably coupled relationships, independently:

at least two of the plurality of the participating first interlocking counterparts are operative participating first interlocking counterparts; and at least one of the plurality of the non-participating second interlocking counterparts is an operative non-participating second interlocking counterpart;

the plurality of non-participating second interlocking counterparts include at least one non-operative, non-participating second interlocking counterpart, and each one of the at least one non-operative, non-participating second interlocking counterpart, independently, is a non-participating second interlocking counterpart that is disposed on the second longitudinal axis and other than between the participating second interlocking counterparts of an operative adjacent pair;

the participating first interlocking counterparts are releasable from corresponding participating second interlocking counterparts such that the first connected configuration is defeated with effect that the second fastener counterpart is released from the first fastener counterpart and becomes disposed for re-connection to the first fastener counterpart in at least another one of the plurality of connected configurations, wherein the at least another one of the plurality of connected configurations includes a third connected configuration;

wherein:

in the third connected configuration:

for at least one of the at least one releasably coupled relationship, the releasable coupling is a releasable coupling between a one of the at least two operative participating first interlocking counterparts and a one of the at least one non-operative, non-participating second interlocking counterpart.

25. The fastener as claimed in claim 24, wherein:

the re-connection of the second fastener counterpart to the first fastener counterpart in the third connected configuration is with effect that another multi-coupled connected configuration is established.

26. The fastener as claimed in claim 24, wherein:

the re-connection of the second fastener counterpart to the first fastener counterpart in the third connected configuration is with effect that the extent of the overlap between the second fastener counterpart and the first fastener counterpart is changed.

27. The fastener as claimed in claim 17, wherein:

the plurality of first interlocking counterparts includes "X" first interlocking counterparts, wherein "X" is an integer that is greater than or equal to two;

the plurality of second interlocking counterparts includes "Y" second interlocking counterparts, wherein "Y" is an integer that is greater than "X"; and "X" is a minimum of two and a maximum of five; and "Y" is a minimum of three and a maximum of twenty-five.

28. The fastener as claimed in claim 17;

wherein:

the first fastener counterpart is made from a first fastener counterpart material;

the second fastener counterpart is made from a second fastener counterpart material;

and at least the second fastener counterpart material is polyethylene or a mixture comprising polyethylene and one or more other polymers.

29. The fastener as claimed in claim 28;

wherein:

the one or more other polymers include a polyolefin elastomer (POE) and/or ethylene-vinyl acetate.

30. The fastener as claimed in claim 28;

wherein:

the polyethylene is selected from the group consisting of: low-density polyethylene, high-density polyethylene, and a combination of low-density polyethylene and high-density polyethylene.

* * * * *